US011499216B2

(12) United States Patent
Pinger et al.

(10) Patent No.: US 11,499,216 B2
(45) Date of Patent: Nov. 15, 2022

(54) METHOD AND FLUX FOR HOT GALVANIZATION

(71) Applicant: Fontaine Holdings NV, Houthalen (BE)

(72) Inventors: Thomas Pinger, Haltern am See (DE); Lars Baumgürtel, Nottuln (DE)

(73) Assignee: Fontaine Holdings NV

( * ) Notice: Subject to any disclaimer, the term of this patent is extended or adjusted under 35 U.S.C. 154(b) by 227 days.

(21) Appl. No.: 16/309,631

(22) PCT Filed: Mar. 13, 2017

(86) PCT No.: PCT/EP2017/055798

§ 371 (c)(1),
(2) Date: Dec. 13, 2018

(87) PCT Pub. No.: WO2017/215796

PCT Pub. Date: Dec. 21, 2017

(65) Prior Publication Data

US 2019/0144983 A1 May 16, 2019

(30) Foreign Application Priority Data

Jun. 13, 2016 (DE) ..... 102016007107.9
Jun. 27, 2016 (DE) ..... 102016111725.0

(51) Int. Cl.
*C23C 2/02* (2006.01)
*C23C 2/30* (2006.01)
(Continued)

(52) U.S. Cl.
CPC ..... *C23C 2/30* (2013.01); *C23C 2/003* (2013.01); *C23C 2/02* (2013.01); *C23C 2/06* (2013.01); *C23C 2/26* (2013.01)

(58) Field of Classification Search
None
See application file for complete search history.

(56) References Cited

U.S. PATENT DOCUMENTS

2014/0120368 A1* 5/2014 Warichet ..... C23C 2/06 428/659

FOREIGN PATENT DOCUMENTS

CN 105648377 A * 6/2016
CN 105648377 A * 6/2016
(Continued)

OTHER PUBLICATIONS

Machine Translation of JP-05117835-A.*
Machine Translation of CN 105648377A.*
Machine Translation of JP-2015045090-A.*

*Primary Examiner* — David P Turocy
(74) *Attorney, Agent, or Firm* — Edward E. Sowers; Brannon Sowers & Cracraft PC

(57) ABSTRACT

The invention relates to the technical field of galvanization of iron-based or iron-containing components, especially steel-based or steel-containing components (steel components), preferably for the automotive or motor vehicle industry, but also for other industrial fields of application (for example for the construction industry, the field of general mechanical engineering, the electrical engineering industry etc.), by means of hot galvanization (hot clip galvanization). More particularly, the invention relates to a method of hot galvanization (hot dip galvanization) and to a plant for this purpose, and additionally to a flux and flux bath usable in this connection and to the respective uses thereof, and additionally also to the products obtainable by the method and/or in the plant (i.e. hot galvanized iron or steel components).

12 Claims, 2 Drawing Sheets

(51) Int. Cl.

| | |
|---|---|
| ***C23C 2/06*** | (2006.01) |
| ***C23C 2/26*** | (2006.01) |
| ***C23C 2/00*** | (2006.01) |

(56) References Cited

FOREIGN PATENT DOCUMENTS

| | | | | | |
|---|---|---|---|---|---|
| DE | 2317600 | | | 10/1974 | |
| DE | 2317600 | A1 | * | 10/1974 | ..... C23C 2/30 |
| EP | 1694880 | A2 | | 8/2006 | |
| EP | 2725115 | A1 | * | 4/2014 | ..... C23C 2/06 |
| EP | 2725116 | A1 | | 4/2014 | |
| GB | 1502673 | A | * | 3/1978 | ..... C23C 2/30 |
| JP | 05117835 | A | * | 5/1993 | |
| JP | 2015045090 | A | * | 3/2015 | |
| WO | 9504607 | A1 | | 2/1995 | |
| WO | WO-9504607 | A1 | * | 2/1995 | ..... C23C 2/30 |
| WO | 2005056867 | A1 | | 6/2005 | |

* cited by examiner

METHOD AND FLUX FOR HOT GALVANIZATION

CROSS-REFERENCES TO RELATED APPLICATIONS

This application is a National Stage filing of International Application PCT/EP 2017/055798, filed Mar. 13, 2017, entitled METHOD AND FLUX FOR HOT GALVANIZATION, claiming priority to German Application Nos. DE 10 2016 007 107.9, filed Jun. 13, 2016, and to DE 10 2016 111 725.0, filed Jun. 27, 2016. The subject application claims priority to PCT/EP 2017/055798, to DE 10 2016 007 107.9, and to DE 10 2016 111 725.0 and incorporates all by reference herein, in their entirety.

BACKGROUND OF THE INVENTION

The present invention relates to the technical field of the galvanization of iron-based or iron-containing components, more particularly steel-based or steel-containing components (steel components), preferably for the automobile or automotive industry, but also for other technical fields of application (e.g., for the construction industry, the sector of general mechanical engineering, the electrical industry, etc.), by means of hot dip galvanizing.

The present invention relates more particularly to a method for hot dip galvanizing and also to a relevant system and, furthermore, to a flux and flux bath which can be used in this context, and also to their respective use, and, furthermore, to the products obtainable by the method of the invention and/or in the system of the invention (i.e., hot dip galvanized iron and steel components).

Metallic components of any kind made from iron-containing material, and more particularly components made of steel, often have applications requiring them to receive efficient protection from corrosion. In particular, components made of steel for motor vehicles (automotive), such as automobiles, trucks, utility vehicles, etc., and for other technical sectors as well (e.g., construction industry, mechanical engineering, electrical industry, etc.), require efficient protection from corrosion that withstands even long-term exposures.

In this connection it is known practice to protect steel-based components against corrosion by means of galvanizing (zincking). In galvanizing, the steel is provided with a generally thin zinc coating in order to protect the steel from corrosion. There are various galvanizing methods that can be used here to galvanize components made of steel, in other words to coat them with a metallic covering of zinc, including in particular the methods of hot dip galvanizing, zinc metal spraying (flame spraying with zinc wire), diffusion galvanizing (sherardizing), electroplate galvanizing (electrolytic galvanizing), nonelectrolytic zincking by means of zinc flake coatings, and also mechanical zincking. There are great differences between the aforesaid zincking and galvanizing methods, particularly with regard to their implementation, but also to the nature and properties of the zinc layers or zinc coatings produced.

Probably the most important method for corrosion protection of steel by means of metallic zinc coatings is that of hot dip galvanizing. This process sees steel immersed continuously (e.g., coil and wire) or in pieces (e.g., components) in a heated tank containing liquid zinc at temperatures from around 450° C. to 600° C. (melting point of zinc: 419.5° C.), thus forming on the steel surface a resistant alloy layer of iron and zinc and, over that, a very firmly adhering pure zinc layer.

Hot dip galvanizing is therefore an established technique and one recognized for many years for protecting components made from ferrous materials, especially steel materials, from corrosion. As outlined above, it involves the immersion of the typically precleaned or pretreated component into a hot liquid zinc bath, in which reaction with the zinc melt takes place and results in the development of a relatively thin zinc layer which is bonded metallurgically to the base material.

In the context of hot dip galvanizing, a distinction is made between discontinuous or batch piece galvanizing (cf., e.g., DIN EN ISO 1461) and continuous coil and wire galvanizing (cf., e.g., DIN EN 10143 and DIN EN 10346). Both piece galvanizing and coil and wire galvanizing are normalized or standardized processes. Continuously galvanized steel coil and continuously galvanized wire are in each case a precursor product or intermediate (semifinished product) which, after having been galvanized, is processed further by means in particular of forming, punching, trimming, etc., whereas components to be protected by piece galvanizing are first fully manufactured and only thereafter subjected to hot dip galvanizing (thus providing the components with all-round corrosion protection). Piece galvanizing and coil/wire galvanizing also differ in terms of the thickness of the zinc layer, resulting in different durations of protection—dependent on the zinc layer as well. The zinc layer thickness of coil-galvanized sheets is usually not more than 20 to 25 micrometers, whereas the zinc layer thicknesses of piece-galvanized steel parts are customarily in the range from 50 to 200 micrometers and even more.

Hot dip galvanizing affords both active and passive corrosion protection. The passive protection is through the barrier effect of the zinc coating. The active corrosion protection comes about on the basis of the cathodic activity of the zinc coating. Relative to more noble metals in the electrochemical voltage series, such as iron, for example, zinc acts as a sacrificial anode, protecting the underlying iron from corrosion until the zinc itself is corroded entirely.

The piece galvanizing according to DIN EN ISO 1461 is used for the hot dip galvanizing of usually relative large steel components and steel constructions. It sees steel-based blanks or completed workpieces (components) being pretreated and then immersed into the zinc melt bath. The immersion allows, in particular, even internal faces, weld seams, and difficult-to-access locations on the components or workpieces for galvanizing to be readily reached.

Conventional hot dip galvanizing is based in particular on the dipping of iron or steel components into a zinc melt to form a zinc coating or zinc covering on the surface of the components. In order to ensure the adhesiveness, the imperviousity, and the unitary nature of the zinc coating, there is generally a requirement beforehand for thorough surface preparation of the components to be galvanized, customarily comprising a degrease with subsequent rinsing operation, a subsequent acidic pickling with downstream rinsing operation, and, finally, a flux treatment (i.e., so-called fluxing) with a subsequent drying operation.

In the case of piece galvanizing, for reasons of process economy and economics, identical or similar components (e.g., mass production of automotive components) are typically collated or grouped for the entire process (this being done in particular by means of a common article carrier, designed for example as a crosspiece or rack, or of a common mounting or attachment apparatus for a multiplicity of these identical or similar components). For this purpose, a plurality of components is attached on the article carrier via holding means, such as latching means, tie wires or the like, for example. The components in the grouped state are subsequently supplied via the article carrier to the individual treatment steps or treatment stages in the hot dip galvanizing process.

The typical process sequence of conventional piece galvanizing by hot dip galvanization customarily takes the following form:

First of all, the component surfaces of the relevant components are subjected to degreasing, in order to remove residues of greases and oils, employing degreasing agents in the form, customarily, of aqueous alkaline or acidic degreasing agents. Cleaning in the degreasing bath is followed customarily by a rinsing operation, typically by immersion into a water bath, in order to prevent degreasing agents being entrained with the galvanization material into the next operation step of pickling, this being especially important in the case of a switch from alkaline degreasing to an acidic pickle.

The next step is that of pickle treatment (pickling), which serves in particular to remove homologous impurities, such as rust and scale, for example, from the steel surface. Pickling is accomplished customarily in dilute hydrochloric acid, with the duration of the pickling procedure being dependent on factors including the contamination status (e.g., degree of rusting) of the galvanization material, and on the acid concentration and temperature of the pickling bath. In order to prevent or minimize entrainments of residual acid and/or residual salts with the galvanization material, the pickling treatment is customarily followed by a rinsing operation (rinse step).

This is followed by what is called fluxing (treatment with flux), in which the previously degreased and pickled steel surface with what is called a flux, typically encompassing an aqueous solution of inorganic chlorides, most frequently with a mixture of zinc chloride ($ZnCl_2$) and ammonium chloride ($NH_4Cl$). On the one hand, the task of the flux is to carry out a final intensive ultrafine purification of the steel surface prior to the reaction of the steel surface with the molten zinc, and to dissolve the oxide skin on the zinc surface, and also to prevent renewed oxidation of the steel surface before the galvanizing procedure. On the other hand, the flux is intended to increase the wetting capacity between the steel surface and the molten zinc. The flux treatment is typically followed by drying, in order to generate a solid film of flux on the steel surface and to remove adhering water, thus avoiding subsequently unwanted reactions (especially the formation of steam) in the liquid zinc dipping bath.

The components pretreated in the manner indicated above are then subjected to hot dip galvanizing by being immersed into the liquid zinc melt. In the case of hot dip galvanizing with pure zinc, the zinc content of the melt according to DIN EN ISO 1461 is at least 98.0 wt %. After the galvanization material has been immersed into the molten zinc, it remains in the zinc melt bath for a sufficient period, in particular until the galvanization material has assumed its temperature and is coated with a zinc layer. The surface of the zinc melt is typically cleaned to remove, in particular, oxides, zinc ash, flux residues and the like, before the galvanization material is then extracted from the zinc melt again. The component hot dip galvanized in this way is then subjected to a cooling process (e.g., in the air or in a water bath). Lastly, any holding means for the component, such as latching means, tie wires or the like, for example, are removed.

Subsequent to the galvanizing operation, there is customarily an afterworking or aftertreatment operation, which in some cases is complex. This operation sees excess zinc bath residues, particularly what are called droplet runs of the zinc solidifying on the edges, and also oxide residues or ash residues adhering to the component, being removed as far as possible.

One criterion of the quality of hot dip galvanization is the thickness of the zinc coating in μm (micrometers). The standard DIN EN ISO 1461 specifies the minimum values of the requisite coating thicknesses to be afforded, depending on thickness of material, in piece galvanizing. In actual practice, the layer thicknesses are well above the minimum layer thicknesses specified in DIN EN ISO 1461. Generally speaking, zinc coatings produced by piece galvanizing have a thickness in the range from 50 to 200 micrometers or even more.

In the galvanizing procedure, as a consequence of mutual diffusion between the liquid zinc and the steel surface, a coating of iron/zinc alloy layers with differing compositions is formed on the steel part. On withdrawal of the hot dip galvanized articles, a layer of zinc—also referred to as pure zinc layer—remains adhering to the uppermost alloy layer, this layer of zinc having a composition corresponding to that of the zinc melt. On account of the high temperatures associated with hot dipping, a relatively brittle layer is thus formed initially on the steel surface, this layer being based on an alloy (mixed crystals) between iron and zinc, with the pure zinc layer only being formed atop that layer. While the relatively brittle iron/zinc alloy layer does improve the strength of adhesion to the base material, it also hinders the formability of the galvanized steel. Greater amounts of silicon in the steel, of the kind used in particular for the so-called calming of the steel during its production, result in increased reactivity between the zinc melt and the base material and, consequently, in strong growth of the iron/zinc alloy layer. In this way, relatively high overall layer thicknesses are formed. While this does enable a very long period of corrosion protection, it nevertheless also raises the risk, in line with increasing thickness of the zinc layer, that the layer will flake off under mechanical exposure, particularly sudden local exposures, thereby destroying the corrosion protection effect.

In order to counteract the above-outlined problem of the incidence of the rapidly growing, brittle and thick iron/zinc alloy layer, and also to enable relatively low layer thicknesses in conjunction with high corrosion protection on galvanizing, it is known practice from the prior art additionally to add aluminum to the zinc melt or to the liquid zinc bath. By adding 5 wt % of aluminum to a liquid zinc melt, for example, a zinc/aluminum alloy is produced that has a melting temperature lower than that of pure zinc. By using a zinc/aluminum melt (Zn/Al melt) or a liquid zinc/aluminum bath (Zn/Al bath), on the one hand it is possible to realize much lower layer thicknesses for reliable corrosion protection (generally of below 50 micrometers); on the other hand, the brittle iron/tin alloy layer is not formed, because the aluminum—without being tied to any particular theory—initially forms, so to speak, a barrier layer on the steel surface of the component in question, with the actual zinc layer then being deposited on this barrier layer.

Components hot dip galvanized with a zinc/aluminum melt are therefore readily formable, but nevertheless—in spite of the significantly lower layer thickness by comparison with conventional hot dip galvanizing with a quasi-aluminum-free zinc melt-exhibit improved corrosion protection qualities.

Relative to pure zinc, a zinc/aluminum alloy used in the hot dip galvanizing bath exhibits enhanced fluidity qualities. Moreover, zinc coatings produced by hot dip galvanizing carried out using such zinc/aluminum alloys have a greater corrosion resistance (from two to six times better than that of pure zinc), better optical qualities, improved shapeability, and enhanced coatability relative to zinc coatings formed from pure zinc. This technology, furthermore, can also be used to produce lead-free zinc coatings.

A hot dip galvanizing method of this kind using a zinc/aluminum melt or using a zinc/aluminum hot dip galvanizing bath is known, for example, from WO 2002/042512 A1 and the relevant equivalent publications to this patent family (e.g., EP 1 352 100 B1, DE 601 24 767 T2, and US 2003/0219543 A1). Also disclosed therein are suitable fluxes for the hot dip galvanizing by means of zinc/aluminum melt baths, since flux compositions for zinc/aluminum hot dip galvanizing baths are different to those for conventional hot dip galvanizing with pure zinc. With the method disclosed therein it is possible to generate corrosion protection coatings having very low layer thicknesses (generally well below 50 micrometers and typically in the range from 2 to 20 micrometers) and having very low weight in conjunction with high cost-effectiveness, and accordingly the method described therein is employed commercially under the designation of microZINQ® process.

However, prior-art hot dip galvanizing methods employing a zinc/aluminum melt or a zinc/aluminum hot dip galvanizing bath (such as WO 2002/042512 A1, for example) use fluxes containing significant quantities of lead chloride, in order to enable good wettability in relation to the flux treatment, and of nickel chloride, in order to bring about high temperature stability of the flux, and also, possibly, of other transition metal or heavy metal chlorides as well, for achieving further desired properties. Additionally, the adjustment of the pH of the flux bath in the case of prior-art hot dip galvanizing methods is generally done using hydrochloric acid, which in certain circumstances may promote unwanted hydrogen embrittlement of the metal substrate being treated.

In relation to the formation of the zinc layer and the properties thereof, therefore, it has emerged that they may be particularly influenced via alloying elements in the zinc melt. One of the most important elements in this context is aluminum: it has emerged accordingly that with an aluminum content in the zinc melt of just 100 ppm (weight-based), it is possible to improve the optical qualities of the resultant zinc layer in the sense of a brighter, more lustrous appearance. This effect increases continuously as the amount of aluminum in the zinc melt goes up to 1000 ppm (weight-based). It has emerged, moreover, that—as already outlined above—from an aluminum content in the zinc melt of 0.12 wt % upward, an intermetallic Fe/Al phase is formed between the iron material and the zinc layer, and results in the inhibition of the otherwise customary diffusion processes between iron and zinc melt and hence a significant reduction in the growth of the Zn/Fe phases; as a consequence of this, therefore, substantially thinner zinc layers result, at and above this level of aluminum in the zinc melt. It has emerged, lastly, that in principle the corrosion protection effect of the resultant zinc layer increases in line with increasing aluminum content in the zinc melt; the basis for this is that the Al/Zn compounds more quickly form significantly more stable outer layers.

Known examples of the commercial use of aluminum-containing zinc melts are the so-called Galfan® process and the aforementioned microZINQ® process, with an aluminum content in the zinc melt of typically in the range from 4.2 wt % to 6.2 wt %. One of the advantages of this alloy is that around the average value of 5 wt %, there is a eutectic composition of the Al/Zn system with a melting point of 382° C., thereby enabling a reduction in the operating temperature in the galvanizing operation.

Disadvantages associated with the use of aluminum-alloyed or aluminum-containing zinc melts (Zn/Al melts), however, are the much greater difficulty of wetting the iron or steel surface to be galvanized with the hot liquid Zn/Al melt, and the much more sensitive or less easily manageable reaction between the Zn/Al melt and the iron or steel surface of the component to be treated, owing to the high affinity of the aluminum for the iron. This makes it necessary to impose considerably greater requirements—by comparison with an operating sequence when using a pure zinc melt—on the cleanliness of the steel surface after the cleaning steps and prior to immersion into the Zn/Al melt. Moreover, the use of a suitable flux and also preheating of the galvanization material are necessary, to allow the reaction between melt and base material and, consequently, the formation of a homogeneous, impervious zinc coating to take place.

Generally, furthermore, when using aluminum-alloyed or aluminum-containing zinc melts (Zn/Al melts), specific fluxes are required for the flux treatment, these fluxes often including heavy metal compounds (customarily heavy metal chlorides) which are not always environmentally compatible and/or which are unwanted, such as, in particular, lead chloride and/or nickel chloride, but possibly also cobalt, manganese, tin, antimony and/or bismuth chloride, these compounds being necessary in order to ensure flawless subsequent hot dip galvanizing, in particular without defects on the galvanized components. With these fluxes specially designed for hot dip galvanizing with aluminum-alloyed or aluminum-containing zinc melts (Zn/Al melts), the lead chloride is intended in particular to reduce the surface tension and so to improve the wettability of the target component surface by the liquid Zn/Al melt, while the nickel chloride is intended to improve the temperature stability of the flux, particularly in respect of the drying that normally follows flux treatment.

Nevertheless, when using aluminum-alloyed or aluminum-containing zinc melts (Zn/Al melts) according to the prior art, and especially when using the fluxes known from the prior art, there remains a high sensitivity to exogenous impurities, such as greases and oil, for example, which either are not dissolved in the upstream cleaning stages or originate from entrainment through the cleaning stages in spite of rinsing operations. The reason is that, in the pretreatment steps preceding the actual galvanizing operation, the complete removal of all exogenous and homologous impurities (such as, for example, greases and oils, microbes, oxidation residues, etc.) from the steel surface is necessary, such removal typically involving a plurality of alkaline degreasing baths and also acidic pickling baths, with the alkaline and acidic media, respectively, being rinsed off in the usually multiple rinsing stages that follow the respective degreasing and cleaning baths, in order to prevent entrainment into the subsequent operating step. In practice it is found, however, that under the circumstances of the hot dip galvanizing operation, particularly with large volumes of the pretreatment baths, high throughputs of a very wide variety of components to be galvanized, within some cases very high variance of existing surface statuses in the as-supplied state, etc., especially when using aluminum-alloyed or aluminum-containing zinc melts (Zn/Al melts), according to the prior art is accompanied continually by defects on the galvanization material, these defects being attributable typically to inadequate cleaning, alone or in conjunction with inadequately effective flux treatment.

BRIEF SUMMARY OF THE INVENTION

The problem addressed by the present invention therefore lies in the provision of a method for hot dip galvanizing, especially of iron-based or iron-containing components, preferably steel-based or steel-containing components (steel components), using an aluminum-containing or aluminum-alloyed zinc melt, and also of a relevant system for implementing this method, and, furthermore, of a flux or flux bath which can be used for the purposes of the method, where the disadvantages of the prior art as outlined above are to be at least very largely avoided or else at least attenuated.

The aim in particular is to provide a method and a system and a flux (bath) all of which, relative to conventional hot dip galvanizing methods or systems or fluxes or flux baths operated using an aluminum-containing or aluminum-alloyed zinc melt, allow improved process economy and/or a more efficient, more particularly more flexible and/or more reliable, in particular less error-susceptible process sequence and/or improved environmental compatibility.

The aim in particular is that such a method or such a system or such a flux (bath) should manage without the use of significant amounts of heavy metal compounds, especially metal chlorides, such as, more particularly, lead chloride and/or nickel chloride, but possibly also other heavy metal chlorides as well, such as cobalt, manganese, tin, antimony and/or bismuth chloride, in the context of the flux treatment, and should therefore have improved environmental compatibility, while nevertheless reliably ensuring that the treated components are galvanized efficiently and without errors.

In order to solve the problem outlined above, the present invention proposes—according to a first aspect of the present invention—a method for hot dip galvanizing; further, especially particular and/or advantageous, configurations of the method of the invention are provided.

Furthermore, the present invention—according to a second aspect of the present invention—relates to a system for hot dip galvanizing; further, especially particular and/or advantageous, configurations of the system of the invention are similarly provided.

The present invention, furthermore, relates—according to a third aspect of the present invention—to a flux bath for the flux treatment of iron or steel components in a hot dip galvanizing method; further, especially particular and/or advantageous, configurations of the flux bath of the invention are further disclosed.

The present invention, furthermore, relates—according to a fourth aspect of the present invention—to a flux composition for the flux treatment of iron or steel components in a hot dip galvanizing method; further, especially particular and/or advantageous, configurations of the flux composition of the invention are provided.

The present invention likewise relates—according to a fifth and sixth aspect of the present invention—to the use of the flux bath of the invention and, respectively, of the flux composition of the invention; further, especially particular and/or advantageous, configurations of the use in accordance with the invention are a subject of further disclosure.

Lastly, the present invention relates—according to a seventh aspect of the present invention—to a hot dip galvanized iron or steel component obtainable by the method of the invention and/or obtainable in the system of the invention; further, especially particular and/or advantageous, configurations of this aspect of the invention are provided.

With regard to the observations hereinafter it is taken as read that embodiments, forms of implementation, advantages and the like which are set out below in relation to only one aspect of the invention, in order to avoid repetition, shall of course also apply accordingly in relation to the other aspects of the invention, without any special mention of this being needed.

For all relative and/or percentage weight-based data stated hereinafter, especially relative quantity or weight data, it should further be noted that within the scope of the present invention they are to be selected by the skilled person in such a way that in total, including all components and/or ingredients, especially as defined hereinbelow, they always add up to or total 100% or 100 wt %; this, however, is self-evident to the skilled person.

In any case, the skilled person is able—based on application or consequent upon an individual case—to depart, when necessary, from the range data recited hereinbelow, without departing from the scope of the present invention.

It is the case, moreover, that all value and/or parameter data stated below, or the like, can in principle be ascertained or determined using standardized or normalized or explicitly specified methods of determination or otherwise by methods of measurement or determination that are familiar per se to the person skilled in this field.

This having been established, the present invention will now be elucidated below in detail.

DETAILED DESCRIPTION OF THE INVENTION

Figure 1:
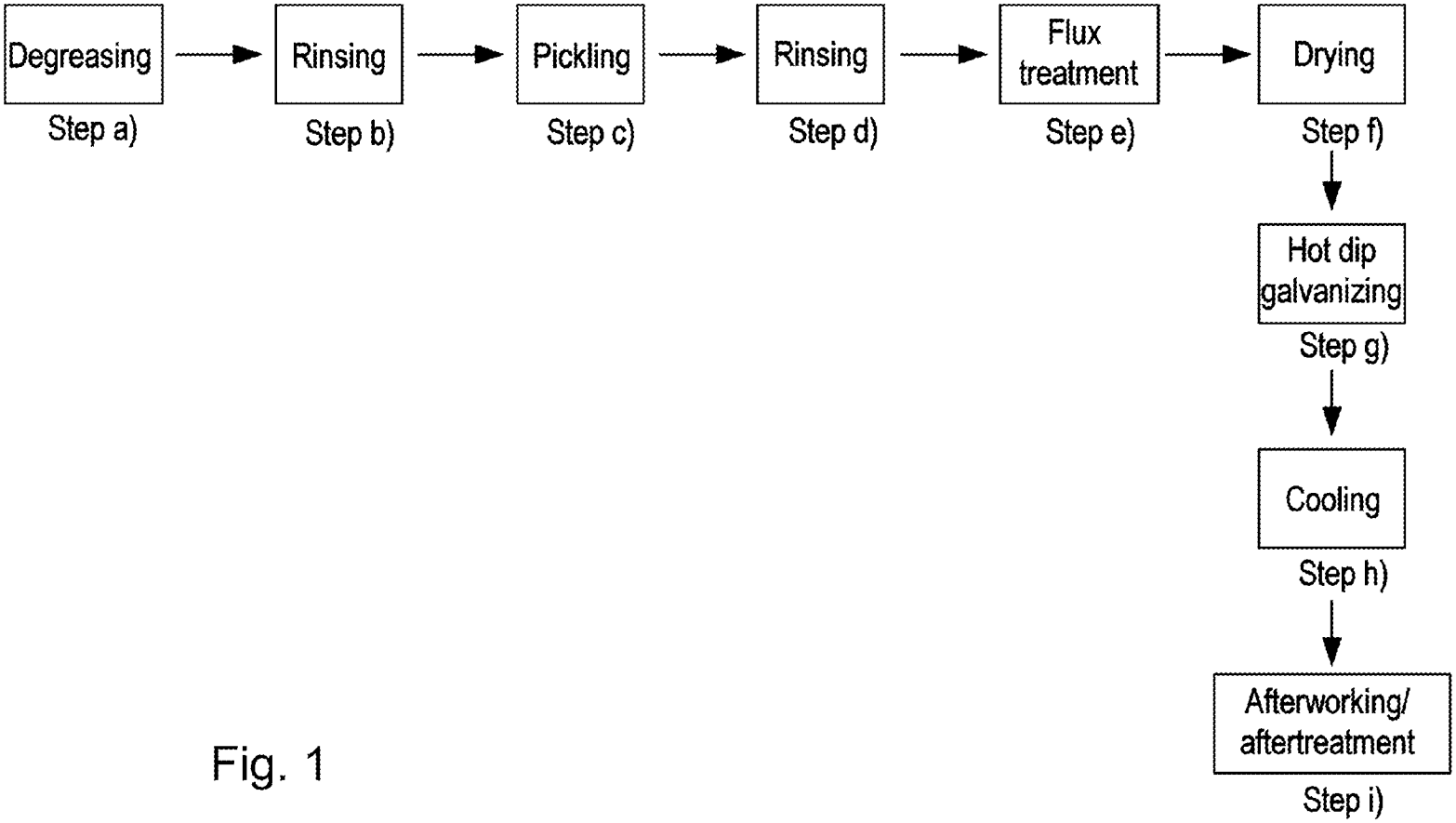
FIG. 1 shows a schematic method sequence of the individual stages or method steps of the method of the invention according to one particular embodiment of the present invention.

A subject of the present invention—according to a first aspect of the present invention—is therefore a method for hot dip galvanizing an iron or steel component, where the method comprises the following method steps in the order listed below:

(a) degreasing treatment, preferably alkaline degreasing treatment, of the iron or steel component, more particularly in at least one degreasing bath; then (b) optionally rinsing of the iron or steel component degreased in method step (a), more particularly in at least one rinsing bath; then (c) pickling treatment, preferably acidic pickling treatment, of the iron or steel component degreased in method step (a) and optionally rinsed in method step (b), more particularly in at least one pickling bath; then (d) optionally rinsing of the iron or steel component pickled in method step (c), more particularly in at least one rinsing bath; then (e) flux treatment of the iron or steel component pickled in method step (c) and optionally rinsed in method step (d), by means of a flux composition in a flux bath, where the flux bath encompasses a liquid phase comprising an alcohol/water mixture, the liquid phase of a flux bath comprising the flux composition, more particularly in dissolved or dispersed form, preferably in dissolved form, and where the flux composition comprises as ingredients (i) zinc chloride ($ZnCl_2$), (ii) ammonium chloride ($NH_4Cl$), (iii) optionally at least one alkali metal and/or alkaline earth metal salt and (iv) at least one aluminum salt and/or at least one silver salt, more particularly aluminum chloride ($AlCl_3$) and/or silver chloride (AgCl), preferably aluminum chloride ($AlCl_3$), and where the flux composition is at least substantially free, preferably entirely free, from lead chloride ($PbCl_2$) and nickel chloride ($NiCl_2$); then (f) optionally drying treatment of the iron or steel component subjected to the flux treatment in method step (e); then (g) hot dip galvanizing of the iron or steel component subjected to the flux treatment in method step (e) and optionally dried in method step (f), in an aluminum-containing, more particularly aluminum-alloyed zinc melt ("Zn/Al melt"), more particularly in a galvanizing bath comprising the aluminum-containing, more particularly aluminum-alloyed zinc melt, preferably by immersion of the iron or steel component into the aluminum-containing, more particularly aluminum-alloyed, zinc melt and/or into the galvanizing bath.

As observed below, the present invention is associated with a multiplicity of entirely unexpected advantages, distinctivenesses and surprisingly technical effects, the outlining of which below makes no claim to completeness but does illustrate the inventive character of the present invention:

Surprisingly, success is achieved in the context of the present invention in employing a flux, i.e., a flux bath or a flux composition, which manages without the presence of lead chloride ($PbCl_2$) and nickel chloride ($NiCl_2$), in spite of the difficult hot dip galvanizing using aluminum-containing or aluminum-alloyed zinc melts, and which preferably also forgoes other transition metal chlorides in the flux, particularly in the flux bath or the flux composition, such as, in particular, cobalt chloride ($CoCl_2$), manganese chloride ($MnCl_2$), tin chloride ($SnCl_2$), bismuth chloride ($BiCl_3$) and antimony chloride ($SbCl_3$), and does so without detriment to the quality of the resultant hot dip galvanization layer.

Quite the contrary is the case: within the present invention, the resulting hot dip galvanization layers are entirely free from defects and possess, moreover, improved corrosion protection properties and also, generally, excellent, if indeed not improved, mechanical and other properties (e.g., optical properties, such as gloss).

As observed below, a distinctive feature of the present invention in this context is to be seen in that the flux used in accordance with the invention, more particularly the flux composition or flux bath used in accordance with the invention, comprises at least one aluminum salt and/or at least one silver salt, more particularly aluminum chloride ($AlCl_3$) and/or silver chloride (AgCl), preferably aluminum chloride ($AlCl_3$), preferably in very small amounts, with the consequence that organic and/or inorganic impurities (such as suspended matter, for example), still present as a result, for example, of the upstream treatment steps, in spite of rinsing operations, and leading in general to the formation of defects during hot dip galvanizing, can be separated out or removed by precipitation, thus making it possible to do entirely without additional transition metal chlorides for improving the wetting behavior or other properties in the context of the flux, more particularly flux bath or flux composition, of the invention.

In combination with a liquid phase of the flux bath that is based on a water/alcohol mixture, the efficiency of the method of the invention can be further improved: as observed in detail below, the required flux film drying times as a result of the alcohol fraction in the flux bath, and/or the drying temperatures, can be lowered significantly. Moreover, film formation and wetting with the flux are homogenized in this way.

A particular effect of the present invention in relation to hot dip galvanizing by means of aluminum-alloyed or aluminum-containing zinc melts is a significantly improved process economy and a more efficient, more particularly more flexible and/or more reliable, more particularly less error-susceptible, process sequence, and also an improved environmental compatibility, owing in particular to the absence of lead chloride and nickel chloride and also, possibly, further transition metal chlorides or heavy metal chlorides in the flux used, but also to the alcohol fraction in the flux bath.

The present invention, accordingly, owing in particular to its improved environmental compatibility, can be employed even in environmentally sensitive areas where the intention is to avoid transition metal and heavy metal compounds, more particularly transition metal and heavy metal chlorides.

The present invention manages in particular without the use of significant amounts of transition metal and heavy metal compounds, especially transition metal and heavy metal chlorides, such as, in particular, lead chloride and/or nickel chloride, but also, possibly, other heavy metal chlorides, such as cobalt, manganese, tin, antimony and/or bismuth chloride, in the context of flux treatment, while nevertheless reliably ensuring that the components treated are galvanized efficiently and without defect.

The distinctive features of the method of the invention and of the system of the invention, which is described hereinafter, are also directly reflected in the method products obtainable, in other words in the hot dip galvanized iron and steel components: these components not only have improved mechanical and optical properties and improved corrosion protection properties, but are also, furthermore, completely free from defects, while having relatively low thicknesses of the hot dip galvanization layer. Furthermore, no unwanted transition metals or heavy metals can be entrained from the flux into the ultimately resulting hot dip galvanization layer, since within the flux treatment process, according to the present invention, transition metals and heavy metals are avoided entirely.

Transition metals and/or heavy metals are, if at all, added or alloyed in deliberately to the zinc melt or hot dip galvanizing bath, respectively, in order to bring about targeted adjustment of particular properties of the hot dip galvanization layer, but in that case are so added or alloyed in an environmentally compatible way, given that they are a firm constituent of the hot dip galvanization layer and are incorporated or intercollated therein as a solid alloy constituent.

The individual ingredients or components of the flux composition used in accordance with the invention and of the flux bath used in accordance with the invention interact synergistically: by virtue in particular of the sheetlike formation of the dried $ZnCl_2$ crystals, the zinc chloride ensures very good coverage of the iron or steel surface. Since, however, 100% coverage is virtually unobtainable and since there may always be relatively small oxidation sites or a thin oxidation layer, the flux composition is further admixed with a sufficient amount of ammonium chloride, which deposits on the component surface and, at the instant of immersion into the zinc melt, undergoes thermal decomposition to form $NH_3$ and HCl, thereby removing final oxide residues from the component surface. Since, in the case of an unduly increased $NH_4Cl$ fraction, there is a marked reduction in the melting point of the $ZnCl_2.NH_4Cl$ mixture relative to pure zinc chloride (around 300° C.), alkali metal and/or alkaline earth metal salts are added, more particularly NaCl and/or KCl, which lift the melting point of the flux composition and so enable substantial and effective drying.

Moreover, it has now surprisingly emerged that the use of silver and/or aluminum salt, more particularly AgCl and/or $AlCl_3$, in the flux or flux composition raises the purity of the flux or flux composition, the reason being is that silver and/or aluminum salt, more particularly AgCl and/or $AlCl_3$, removes or causes precipitation of organic and/or inorganic impurities, such as suspended matter, for example, which may be entrained, for example, from the upstream pretreatment steps, in spite of multiple rinsing operations, this entrainment being consistent in amounts which, though only small, are nevertheless sufficiently large for the formation of defects in the case of Zn/Al melts. Examples of such impurities are microbes or bacteria (e.g., entrained from the degreasing), and also phosphates and sulfates (e.g., entrained from the pickle). The precipitation of these substances prevents them being transferred to the component surface, and the source of defective galvanizations is therefore eliminated.

It has emerged, furthermore, that the use of alcohol in the flux bath, as an at least partial replacement for the otherwise purely aqueous bases commonly employed, is beneficial in a number of respects on the operating regime and on the galvanizing outcome.

As a result of the alcohol content, it is possible for very small impurities to be dissolved in the flux as well (these impurities then being precipitated out, in the case of organic substances, by the aluminum and/or silver salt used, more particularly $AlCl_3$ and/or AgCl), thereby achieving an improved cleaning effect.

The presence of alcohol allows a reduction in the time needed for the drying of the flux film, particularly owing to the lower evaporation point of alcohol relative to water. This leads to a notable improvement relative to the existing state of the art, where the galvanizing cycle defines the maximum drying time and as a result frequently, particularly in the case of solid components, the drying time is not enough for adequate drying of the film of the flux. A fully dried film of flux allows a clean reaction with the zinc melt, without any splashes resulting from evaporation of residual water. Similarly, improved drying results in less zinc ash, thereby reducing the risk of zinc ash accumulations on the galvanization material (i.e., better galvanizing quality and less afterwork expenditure). More rapid drying, furthermore, means that the drying time and/or drying temperature can be reduced, with the consequent result of an energy saving and/or of an increase in productivity. Also quicker is the burning-off of the flux in the zinc bath (likewise owing to the lower evaporation point), meaning that the energy of the zinc melt is able to flow directly into the heating of the component, leading in turn to a more rapid and more efficient galvanizing operation.

The fraction of alcohol used is dependent in particular on the aluminum content of the zinc melt used, on the required drying or preheating (which is dependent in turn on the component geometry, particularly the thickness of material, with thicker components requiring longer drying times, on the zinc alloy used, and also on the thickness of the applied film of flux, with thicker flux layers requiring longer drying times, depending on the salt concentration, rate of removal, roughness of the steel surface, etc.), on the existing degree of contamination of the galvanization material, and also on the technical circumstances of the system (e.g., power of the drying oven, cycle time of the galvanization operation, suction removal rate of the flux bath, etc.).

As a result, given the same drying conditions (i.e., identical drying times and drying temperatures), the use of alcohol in the flux bath, even at low quantitative fractions and up to high quantitative fractions, leads to more rapid drying of the film of flux and to a better quality of galvanizing. A result of this is that better drying leads to improved quality of galvanizing. In corrosion tests as well (e.g., salt spray test or salt spray mist test according to DIN EN ISO 9227:2012), the hot dip galvanized components pretreated with an alcohol-containing flux exhibit much longer service lives (up to 20% improvement in service life or even more) relative to hot dip galvanized components pretreated with an otherwise identical flux (but without any alcohol fraction, i.e., purely aqueous).

Within the present invention, therefore, it is possible to provide an efficiently operating and environmentally compatible hot dip galvanizing method and a corresponding system, where the above-outlined disadvantages of the prior art can be at least very largely avoided or at least attenuated.

Below, preferred configurations of the method of the invention and of the method process of the invention are described and elucidated in more detail:

as described above, the method of the invention encompasses the above-outlined method steps (a) to (g). Method steps (a) to (d) can be carried out fundamentally in the manner known per se to the skilled person. This is also true in principle of the fundamental implementation of the remaining method steps, and especially in relation to the method step (e) of the flux treatment as well.

According to the present invention, within method step (e), the flux bath is customarily acidically adjusted.

According to the present invention, the flux bath is adjusted to a defined and/or stipulated, more particularly acidic, pH, more particularly in the pH range from 0 to 6.9, preferably in the pH range from 0.5 to 6.5, more preferably in the pH range from 1 to 5.5, very preferably in the pH range from 1.5 to 5, especially preferably in the pH range from 2 to 4.5, more preferably still in the pH range from 2 to 4.

According to one particularly preferred embodiment, the flux bath is adjusted to a defined and/or stipulated, more particularly acidic, pH, the pH being adjusted by means of a preferably inorganic acid in combination with a preferably inorganic basic compound, more particularly ammonia ($NH_3$). This embodiment, i.e., the fine-tuning of the pH by means of a preferably organic basic compound, more particularly ammonia ($NH_3$), is advantageous in particular because in this way any unwanted hydrogen embrittlement of the component to be treated is counteracted.

With regard to the flux bath of the invention, more particularly to the alcohol/water mixture of the liquid phase of the flux bath, it is possible for the weight-based alcohol/water proportion to be varied within wide ranges. In general the flux bath comprises the alcohol/water mixture in a weight-based alcohol/water ratio in the range from 0.5:99.5 to 99:1, more particularly in the range from 2:98 to 95:5, preferably in the range from 5:95 to 90:10, more preferably in the range from 5:95 to 50:50, very preferably in the range from 5:95 to 45:55, especially preferably in the range from 5:95 to 50:50, more preferably still in the range from 10:90 to 30:70, based on the alcohol/water mixture.

According to one particular embodiment, the flux bath comprises the alcohol, based on the alcohol/water mixture, in an amount of at least 0.5 wt %, more particularly in an amount of at least 1 wt %, preferably in an amount of at least 2 wt %, more preferably in an amount of at least 3 wt %, more preferably still in an amount of at least 4 wt %.

The flux bath typically comprises the alcohol, based on the alcohol/water mixture, in an amount of up to 90 wt %, more particularly in an amount of up to 70 wt %, preferably in an amount of up to 50 wt %, more preferably in an amount of up to 30 wt %, more preferably still in an amount of up to 25 wt %.

According to one embodiment of the present invention, the alcohol of the alcohol/water mixture of the flux bath is selected from alcohols having boiling points under atmospheric pressure (1.013.25 hPa) in the range from 40° to 200° C., more particularly in the range from 45° C. to 180° C., preferably in the range from 50° C. to 150° C., more preferably in the range from 55° C. to 130° C., very preferably in the range from 60° C. to 110° C.

The alcohol of the alcohol/water mixture of the flux bath is preferably a water-miscible and/or a water-soluble alcohol.

The alcohol of alcohol/water mixture of the flux bath is preferably an alcohol which forms an azeotropic mixture with water.

The alcohol of the alcohol/water mixture of the flux bath is generally selected from the group of $C_1$-$C_{10}$ alcohols, more particularly $C_1$-$C_6$ alcohols, preferably $C_1$-$C_4$ alcohols and mixtures thereof.

According to one particular embodiment, the alcohol of the alcohol/water mixture of the flux bath is selected from the group of linear or branched, saturated or unsaturated, aliphatic, cycloaliphatic or aromatic, primary, secondary or tertiary, mono-, di- or trihydric $C_1$-$C_{10}$ alcohols and mixtures thereof, more particularly $C_1$-$C_6$ alcohols, preferably $C_1$-$C_4$ alcohols, more preferably from the group of linear or branched, saturated, aliphatic, primary, secondary or tertiary monohydric $C_1$-$C_{10}$ alcohols and mixtures thereof, more particularly $C_1$-$C_6$ alcohols, preferably $C_1$-$C_4$ alcohols.

According to one particular embodiment of the present invention, the alcohol of the alcohol/water mixture of the flux bath is selected from the group of methanol, ethanol, propan-1-ol, propan-2-ol, butan-1-ol, butan-2-ol, 2-methylpropan-1-ol, 2-methylpropan-2-ol, pentan-1-ol, pentan-2-ol, pentan-3-ol, 2-methylbutan-1-ol, 3-methylbutan-1-ol, 2-methylbutan-2-ol, 3-methylbutan-2-ol, 2,2-dimethylpropan-1-ol, hexan-1-ol, heptan-1-ol, octan-1-ol, nonan-1-ol, decan-1-ol, ethane-1,2-diol, propane-1,2-diol, cyclopentanol, cyclohexanol, prop-2-en-1-ol, but-2-en-1-ol and mixtures thereof, more particularly from the group of methanol, ethanol, propan-1-ol, propan-2-ol, butan-1-ol, butan-2-ol, 2-methylpropan-1-ol, 2-methylpropan-2-ol, pentan-1-ol, pentan-2-ol, pentan-3-ol, 2-methylbutan-1-ol, 3-methylbutan-1-ol, 2-methylbutan-2-ol, 3-methylbutan-2-ol, 2,2-dimethylpropan-1-ol and mixtures thereof, more preferably from the group of methanol, ethanol, propan-1-ol, propan-2-ol, butan-1-ol, butan-2-ol, 2-methylpropan-1-ol, 2-methylpropan-2-ol and mixtures thereof, more preferably still from the group of methanol, ethanol, propan-1-ol, propan-2-ol, butan-1-ol, butan-2-ol and mixtures thereof.

According to one particularly preferred embodiment, the alcohol of the alcohol/water mixture of the flux bath is selected from the group of methanol, ethanol, propan-1-ol, propan-2-ol, butan-1-ol, butan-2-ol and mixtures thereof.

According to one particular embodiment of the present invention, the alcohol of the alcohol/water mixture is a surfactant alcohol (i.e., an alcohol having surfactant properties), more particularly selected from alkoxylated, preferably ethoxylated or proxylated, $C_6$-$C_{25}$ alcohols, preferably $C_8$-$C_{15}$ alcohols, and alkoxylated, preferably ethoxylated or propoxylated, fatty alcohols, preferably $C_6$-$C_{30}$ fatty alcohols, hydroxyl-functional polyalkylene glycol ethers, hydroxyl-functional fatty alcohol alkoxylates, more particularly $C_6$-$C_{30}$ fatty alcohol alkoxylates, hydroxyl-functional alkyl(poly)glucosides and hydroxyl-functional alkylphenol alkoxylates and also mixtures thereof. This particular embodiment of the present invention has the advantage that the use of an additional surfactant or wetting agent can be efficiently avoided, since in this case the alcohol component exhibits or provides a surfactant and/or wetting agent function in the same way. Surfactant alcohols of these kinds are available commercially and are sold for example by TIB Chemicals AB, Mannheim, Germany.

With regard to the flux bath used in accordance with the invention, the flux bath—in addition to the abovementioned ingredients and/or components—may further comprise at least one wetting agent and/or surfactant, more particularly at least one ionic or nonionic wetting agent and/or surfactant, preferably at least one nonionic wetting agent and/or surfactant.

The amounts of the wetting agent and/or surfactant in question may vary within wide ranges:

In particular the flux bath may comprise the at least one wetting agent and/or surfactant in amounts of 0.0001 to 15 wt %, preferably in amounts of 0.001 to 10 wt %, more preferably in amounts of 0.01 to 8 wt %, more preferably still in amounts of 0.01 to 6 wt %, very preferably in amounts of 0.05 to 3 wt %, more preferably still in amounts of 0.1 to 2 wt %, based on the flux bath.

Furthermore, the flux may comprise the at least one wetting agent and/or surfactant in particular in amounts of 0.0001 to 10 vol %, preferably in amounts of 0.001 to 8 vol %, more preferably in amounts of 0.01 to 5 vol %, more preferably still in amounts of 0.01 to 5 vol %, very preferably in amounts of 0.05 to 3 vol %, more preferably still in amounts of 0.1 to 2 vol %, based on the flux bath.

The amount and/or concentration of the flux composition used in accordance with the invention in the flux bath used in accordance with the invention may equally vary within wide ranges:

Customarily, the flux bath may comprise the flux composition in an amount of at least 150 g/l, more particularly in an amount of at least 200 g/l, preferably in an amount of at least 250 g/l, more preferably in an amount of at least 300 g/l, very preferably in an amount of at least 400 g/l, especially preferably in an amount of at least 450 g/l, more preferably still in an amount of at least 500 g/l, more particularly calculated as total salt content of the flux composition.

The flux bath may preferably comprise the flux composition in an amount of 150 g/l to 750 g/l, more particularly in an amount of 200 g/l to 700 g/l, preferably in an amount of 250 g/l to 650 g/l, more preferably in an amount of 300 g/l to 625 g/l, very preferably in an amount of 400 g/l to 600 g/l, especially preferably in an amount of 450 g/l to 580 g/l, more preferably still in an amount of 500 g/l to 575 g/l, more particularly calculated as total salt content of the flux composition.

With regard to the flux composition used in accordance with the invention as such, the flux composition may comprise as ingredients (i) zinc chloride ($ZnCl_2$), more particularly in amounts in the range from 50 to 95 wt %, preferably in the range from 55 to 90 wt %, more preferably in the range from 60 to 85 wt %, more preferably in the range from 65 to 82.5 wt %, more preferably still in the range from 70 to 82 wt %, (ii) ammonium chloride ($NH_4Cl$), more particularly in amounts in the range from 5 to 45 wt %, preferably in the range from 7.5 to 40 wt %, more preferably in the range from 10 to 35 wt %, very preferably in the range from 11 to 25 wt %, more preferably still in the range from 12 to 20 wt %, (iii) optionally at least one alkali metal and/or alkaline earth metal salt, more particularly in amounts in the range from 0.1 to 25 wt %, preferably in the range from 0.5 to 20 wt %, more preferably in the range from 1 to 15 wt %, very preferably in the range from 2 to 12.5 wt %, more preferably still in the range from 4 to 10 wt %, and (iv) at least one aluminum salt and/or at least one silver salt, more particularly aluminum chloride ($AlCl_3$) and/or silver chloride (AgCl), preferably aluminum chloride ($AlCl_3$), more particularly in amounts in the range from $1\cdot10^{-7}$ to 2 wt %, preferably in the range from $1\cdot10^{-6}$ to 1.5 wt %, more preferably in the range from $1\cdot10^{-5}$ to 1 wt %, very preferably in the range from $2\cdot10^{-5}$ to 0.5 wt %, more preferably still in the range from $5\cdot10^{-5}$ to $5\cdot10^{-3}$ wt %, where all of the above-stated quantity figures are based on the composition and are to be selected such as to result in a total of 100 wt %, and where the flux composition is at least substantially free, preferably entirely free, from lead chloride ($PbCl_2$) and nickel chloride ($NiCl_2$).

With regard to component (iii), i.e., to the alkaline earth metal and/or alkaline earth metal salt, of the flux composition used in accordance with the invention, there are various possibilities for variation here as well:

in particular, the flux composition used in accordance with the invention may comprise, as alkali metal and/or alkaline earth metal salt of component (iii), an alkali metal and/or alkaline earth metal chloride.

Further, the flux composition used in accordance with the invention may comprise, as alkali metal and/or alkaline earth metal salt of component (iii), at least one alkali metal and/or alkaline earth metal salt of an alkali metal and/or alkaline earth metal from the group of lithium (Li), sodium (Na), potassium (K), rubidium (Rb), cesium (Cs), beryllium (Be), magnesium (Mg), calcium (Ca), strontium (Sr) and barium (Ba) and also combinations.

It is preferred in accordance with the invention if the flux composition used in accordance with the invention comprises, as alkali metal and/or alkaline earth metal salt of component (iii), at least two alkali metal and/or alkaline earth metal salts different from one another, more particularly at least two alkali metal and/or alkaline earth metal salts of an alkali metal and/or alkaline earth metal from the group of lithium (Li), sodium (Na), potassium (K), rubidium (Rb), cesium (Cs), beryllium (Be), magnesium (Mg), calcium (Ca), strontium (Sr) and barium (Ba) and also combinations.

It is particularly preferred, moreover, if the flux composition used in accordance with the invention comprises, as alkali metal and/or alkaline earth metal salt of component (iii), at least two alkali metal salts different from one another, more particularly two alkali metal chlorides different from one another, preferably sodium chloride and potassium chloride, more particularly with a sodium/potassium weight ratio in the range from 50:1 to 1:50, more particularly in the range from 25:1 to 1:25, preferably in the range from 10:1 to 1:10.

It is particularly preferred in accordance with the invention if the flux composition used in accordance with the invention is at least substantially free, preferably entirely free, from cobalt chloride ($CoCl_2$), manganese chloride ($MnCl_2$), tin chloride ($SnCl_2$), bismuth chloride ($BiCl_3$) and antimony chloride ($SbCl_3$) as well.

It is likewise preferred in accordance with the invention if the flux composition used in accordance with the invention is at least substantially free, preferably entirely free, from lead chloride ($PbCl_2$), nickel chloride ($NiCl_2$), cobalt chloride ($CoCl_2$), manganese chloride ($MnCl_2$), tin chloride ($SnCl_2$), bismuth chloride ($BiCl_3$) and antimony chloride ($SbCl_3$) and/or if the flux composition is at least substantially free, preferably entirely free, from chlorides from the group of lead chloride ($PbCl_2$), nickel chloride ($NiCl_2$), cobalt chloride ($CoCl_2$), manganese chloride ($MnCl_2$), tin chloride ($SnCl_2$), bismuth chloride ($BiCl_3$) and antimony chloride ($SbCl_3$).

It is further advantageous in accordance with the invention if the flux composition used in accordance with the invention is at least substantially free, preferably entirely free, from salts and compounds of metals from the group of lead (Pb), nickel (Ni), cobalt (Co), manganese (Mn), tin (Sn), bismuth (Bi) and antimony (Sb).

Finally, it is also advantageous in accordance with the invention if the flux composition used in accordance with the invention, apart from zinc chloride ($ZnCl_2$) and also from aluminum salt and/or silver salt, more particularly silver chloride (AgCl) and/or aluminum chloride ($AlCl_3$), is at least substantially free, preferably entirely free, from salts and compounds of transition metals and heavy metals.

With regard to the method step (e) of the flux treatment, the procedure is generally such that the flux treatment in method step (e) takes place by contacting of the iron or steel component with the flux bath and/or the flux composition, more particularly by immersion or spray application, preferably immersion. In particular, it is advantageous here if the iron or steel component is contacted with the flux bath and/or the flux composition for a time of 0.001 to 30 minutes, more particularly 0.01 to 20 minutes, preferably 0.1 to 15 minutes, preferably 0.5 to 10 minutes, more particularly 1 to 5 minutes, being more particularly immersed into the flux bath. In particular, the iron or steel component can be contacted with the flux bath and/or the flux composition for a time of up to 30 minutes, more particularly up to 20 minutes, preferably up to 15 minutes, preferably up to 10 minutes, more particularly up to 5 minutes, being particularly immersed into the flux bath.

With regard to drying treatment in method step (f) of the method of the invention, it is preferred in accordance with the invention if the drying treatment in method step (f) takes place at a temperature in the range from 50 to 400° C., more particularly in the range from 75 to 350° C., preferably in the range from 100 to 300° C., more preferably in the range from 125 to 275° C., very preferably in the range from 150 to 250° C., and/or if the drying treatment in method step (f) takes place at a temperature of up to 400° C., more particularly up to 350° C., preferably up to 300° C., more preferably up to 275° C., very preferably up to 250° C.

Customarily the procedure here is such that the drying treatment in method step (f) is carried out such that the surface of the iron or steel component during drying has a temperature in the range from 100 to 300° C., more particularly in the range from 125 to 275° C., preferably in the range from 150 to 250° C., more preferably in the range from 160 to 225° C., very preferably in the range from 170 to 200° C.

The drying treatment in method step (f) may typically take place in the presence of and/or by means of air.

More particularly, the drying treatment may take place in at least one drying facility, more particularly in at least one oven.

With regard to the aluminum-containing, more particularly aluminum-alloyed, zinc melt used in accordance with the invention ("Zn/Al melt") and/or to the galvanizing bath, the following may be observed in this regard.

According to one typical embodiment of the present invention, it is advantageous if the aluminum-containing, more particularly aluminum-alloyed, zinc melt ("Zn/Al melt") and/or the galvanizing bath comprises an amount of aluminum in the range from 0.0001 to 25 wt %, more particularly in the range from 0.001 to 20 wt %, preferably in the range from 0.005 to 17.5 wt %, more preferably in the range from 0.01 to 15 wt %, very preferably in the range from 0.02 to 12.5 wt %, especially preferably in the range from 0.05 to 10 wt %, more preferably still in the range from 0.1 to 8 wt %, based on the aluminum-containing, more particularly aluminum-alloyed, zinc melt ("Zn/Al melt") and/or the galvanizing bath. More particularly the the aluminum-containing, more particularly aluminum-alloyed, zinc melt ("Zn/Al melt") and/or the galvanizing bath, based on the aluminum-containing, more particularly aluminum-alloyed, zinc melt ("Zn/Al melt") and/or the galvanizing bath can comprise an amount of zinc of at least 75 wt %, more particularly at least 80 wt %, preferably at least 85 wt %, more preferably at least 90 wt %, and also, optionally, can comprise at least one further metal, more particularly in amounts of up to 5 wt % and/or more particularly selected from the group of bismuth (Bi), lead (Pb), tin (Sn), nickel (Ni), silicon (Si), magnesium (Mg) and combinations thereof. Here, all of the above-stated quantity figures are to be selected such as to result in a total of 100 wt %.

Furthermore, it is preferred in accordance with the invention if the aluminum-containing, more particularly aluminum-alloyed, zinc melt ("Zn/Al melt") and/or the galvanizing bath has the following composition, where all of the below-stated quantity figures are based on the aluminum-containing, more particularly aluminum-alloyed, zinc melt ("Zn/Al melt") and/or the galvanizing bath and are to be selected such as to result in a total of 100 wt %:

(i) zinc (Zn), more particularly in amounts in the range from 75 to 99.9999 wt %, more particularly in the range from 80 to 99.999 wt %, preferably in the range from 82.5 to 99.995 wt %, more preferably in the range from 85 to 99.99 wt %, very preferably in the range from 87.5 to 99.98 wt %, especially preferably in the range from 90 to 99.95 wt %, more preferably still in the range from 92 to 99.9 wt %, (ii) aluminum (Al), more particularly in amounts in the range from 0.0001 to 25 wt %, more particularly in the range from 0.001 to 20 wt %, preferably in the range from 0.005 to 17.5 wt %, more preferably in the range from 0.01 to 15 wt %, very preferably in the range from 0.02 to 12.5 wt %, especially preferably in the range from 0.05 to 10 wt %, more preferably still in the range from 0.1 to 8 wt %, (iii) optionally bismuth (Bi), more particularly in amounts of up to 0.5 wt %, preferably in amounts of up to 0.3 wt %, more preferably in amounts of up to 0.1 wt %, (iv) optionally lead (Pb), more particularly in amounts of up to 0.5 wt %, preferably in amounts of up to 0.2 wt %, more preferably in amounts of up to 0.1 wt %, (v) optionally tin (Sn), more particularly in amounts of up to 0.9 wt %, preferably in amounts of up to 0.6 wt %, more preferably in amounts of up to 0.3 wt %, (vi) optionally nickel (Ni), more particularly in amounts of up to 0.1 wt %, preferably in amounts of up to 0.08 wt %, more preferably in amounts of up to 0.06 wt %, (vii) optionally silicon (Si), more particularly in amounts of up to 0.1 wt %, preferably in amounts of up to 0.05 wt %, more preferably in amounts of up to 0.01 wt %, (viii) optionally magnesium (Mg), more particularly in amounts of up to 5 wt %, preferably in amounts of up to 2.5 wt %, more preferably in amounts of up to 0.8 wt %.

If the zinc melt used includes alloying constituents and/or alloying metals other than aluminum, it is possible thereby to control the process regime in a targeted way: for instance, by the presence in particular of lead and bismuth, the surface tension can be reduced and in this way the wettability of the surface to be galvanized can be improved, whereas by the presence of tin it is possible to improve the optical properties, especially the gloss, of the resulting galvanization layer, to reduce further the layer thicknesses by presence of nickel, to extend the service life of the zinc bath vessel (e.g., steel tank) by the presence of silicon, and to improve the corrosion properties, particularly the corrosion resistance, of the resulting galvanization layer by the presence of magnesium.

According to one particular embodiment, the aluminum-containing, more particularly aluminum-alloyed, zinc melt ("Zn/Al melt") and/or the galvanizing bath may have a temperature in the range from 375° C. to 750° C., more particularly temperature in the range from 380° C. to 700° C., preferably temperature in the range from 390° C. to 680° C., more preferably still in the range from 395° C. to 675° C.

Typically, within the hot dip galvanizing step (g), the procedure is that the iron or steel component is immersed into the aluminum-containing, more particularly aluminum-alloyed, zinc melt ("Zn/Al melt") and/or the galvanizing bath, more particularly being immersed therein and agitated, more particularly for a period sufficient to ensure effective hot dip galvanizing, more particularly for a period in the range from 0.0001 to 60 minutes, preferably in the range from 0.001 to 45 minutes, more preferably in the range from 0.01 to 30 minutes, more preferably still in the range from 0.1 to 15 minutes.

In particular, the aluminum-containing, more particularly aluminum-alloyed, zinc melt ("Zn/Al melt") and/or the galvanizing bath may be contacted and/or rinsed or pervaded with at least one inert gas, more particularly nitrogen.

In principle, the method of the invention may be operated continuously or discontinuously.

The iron or steel component to be treated may be a single product or a multiplicity of individual products. In that case a discontinuous procedure is preferred, although a continuous procedure is not ruled out in principle.

Furthermore, the iron or steel component may also be an elongate product, more particularly a wire, tube, sheet or coil material or the like. In this case a continuous procedure is preferred, although in this regard as well a discontinuous procedure is not ruled out.

According to one particular embodiment of the present invention, the hot dip galvanizing carried out in method step (g) may be followed by a cooling step (h), i.e., the iron or steel component hot dip galvanized in method step (g) may be subjected to a cooling treatment (h), optionally followed by a further afterworking and/or aftertreating step (i).

The optional cooling step (h) and/or the optional cooling treatment (h) may take place in particular by means of air and/or in the presence of air, preferably down to ambient temperature.

A further subject of the present invention—according to a second aspect of the present invention—is a system for the hot dip galvanizing of iron or steel components, more particularly a system for implementing a method of the invention as described above, where the system encompasses the following treatment facilities in the order listed below:

(A) at least one degreasing facility, more particularly at least one degreasing bath, for the preferably alkaline degreasing treatment of iron or steel components; downstream in process direction to (A)

(B) optionally at least one rinsing facility, more particularly at least one rinsing bath, for rinsing iron or steel components degreased in the degreasing facility (A); downstream in process direction to (B)

(C) at least one pickling facility, more particularly at least one pickling bath, for the preferably acidic pickling treatment of iron or steel components degreased in the degreasing facility (A) and optionally rinsed in the rinsing facility (B); downstream in process direction to (C)

(D) optionally at least one rinsing facility, more particularly at least one rinsing bath, for rinsing iron or steel components pickled in the pickling facility (C); downstream in process direction to (D)

(E) at least one flux treatment facility for the flux treatment of iron or steel components pickled in the pickling facility (C) and optionally rinsed in the rinsing facility (D), where the flux treatment facility comprises at least one flux bath with a flux composition, where the flux bath encompasses a liquid phase comprising an alcohol/water mixture, the liquid phase of the flux bath comprising the flux composition, more particularly in dissolved or dispersed form, preferably in dissolved form, and where the flux composition comprises as ingredients (i) zinc chloride ($ZnCl_2$), (ii) ammonium chloride ($NH_4Cl$), (iii) optionally at least one alkali metal and/or alkaline earth metal salt and (iv) at least one aluminum salt and/or at least one silver salt, more particularly aluminum chloride ($AlCl_3$) and/or silver chloride (AgCl), preferably aluminum chloride ($AlCl_3$), and where the flux composition is at least substantially free, preferably entirely free, from lead chloride ($PbCl_2$) and nickel chloride ($NiCl_2$); downstream in process direction to (E)

(F) optionally at least one drying facility for drying iron or steel component subjected to a flux treatment in the flux treatment facility (E); downstream in process direction to (F)

(G) at least one hot dip galvanizing facility for the hot dip galvanizing of iron or steel components subjected to a flux treatment in the flux treatment facility (E) and optionally dried in the drying facility (F), where the hot dip galvanizing facility encompasses at least one aluminum-containing, more particularly aluminum-alloyed, zinc melt ("Zn/Al melt"), more particularly at least one galvanizing bath comprising an aluminum-containing, more particularly aluminum-alloyed, zinc melt, preferably designed for immersing iron or steel components.

As described above, the flux bath of the flux treatment facility (E) is customarily acidically adjusted.

In particular, the flux bath is adjusted to a defined and/or stipulated, more particularly acidic, pH, more particularly in the pH range from 0 to 6.9, preferably in the pH range from 0.5 to 6.5, more preferably in the pH range from 1 to 5.5, very preferably in the pH range from 1.5 to 5, especially preferably in the pH range from 2 to 4.5, more preferably still in the pH range from 2 to 4.

According to one particularly preferred embodiment, the flux bath is adjusted to a defined and/or stipulated, more particularly acidic, pH, the pH being adjusted by means of a preferably inorganic acid in combination with a preferably inorganic basic compound, more particularly ammonia ($NH_3$). The advantages associated with this have already been elucidated in connection with the method of the invention.

With regard to the flux bath used within the flux treatment facility (E), the composition thereof may vary within wide ranges:

typically the system is configured such that the flux bath comprises the alcohol/water mixture in a weight-based alcohol/water ratio in the range from 0.5:99.5 to 99:1, more particularly in the range from 2:98 to 95:5, preferably in the range from 5:95 to 90:10, more preferably in the range from 5:95 to 50:50, very preferably in the range from 5:95 to 45:55, especially preferably in the range from 5:95 to 50:50, more preferably still in the range from 10:90 to 30:70, based on the alcohol/water mixture.

The system of the invention is customarily configured such that the flux bath comprises the alcohol, based on the alcohol/water mixture, in an amount of at least 0.5 wt %, more particularly in an amount of at least 1 wt %, preferably in an amount of at least 2 wt %, more preferably in an amount of at least 3 wt %, more preferably still in an amount of at least 4 wt %.

Customarily the system of the invention is configured such that the flux bath comprises the alcohol, based on the alcohol/water mixture, in an amount of up to 90 wt %, more particularly in an amount of up to 70 wt %, preferably in an amount of up to 50 wt %, more preferably in an amount of up to 30 wt %, more preferably still in an amount of up to 25 wt %.

Customarily, in the configuration of the flux bath of the flux treatment facility (E), the procedure is such that the alcohol of the alcohol/water mixture of the flux bath is selected from alcohols having boiling points under atmospheric pressure (1.013.25 hPa) in the range from 40° C. to 200° C., more particularly in the range from 45° C. to 180° C., preferably in the range from 50° C. to 150° C., more preferably in the range from 55° C. to 130° C., very preferably in the range from 60° C. to 110° C.

The alcohol of the alcohol/water mixture of the flux bath is typically a water-miscible and/or a water-soluble alcohol.

The alcohol of the alcohol/water mixture of the flux bath is preferably an alcohol which forms an azeotropic mixture with water.

According to one preferred embodiment, the procedure is such that the alcohol of the alcohol/water mixture of the flux bath is selected from the group of $C_1$-$C_{10}$ alcohols, more particularly $C_1$-$C_6$ alcohols, preferably $C_1$-$C_4$ alcohols and mixtures thereof.

It is further preferred in accordance with the invention if the alcohol of the alcohol/water mixture of the flux bath is selected from the group of linear or branched, saturated or unsaturated, aliphatic, cycloaliphatic or aromatic, primary, secondary or tertiary, mono-, di- or trihydric $C_1$-$C_{10}$ alcohols and mixtures thereof, more particularly $C_1$-$C_6$ alcohols, preferably $C_1$-$C_4$ alcohols, more preferably from the group of linear or branched, saturated, aliphatic, primary, secondary or tertiary monohydric $C_1$-$C_{10}$ alcohols and mixtures thereof, more particularly $C_1$-$C_6$ alcohols, preferably $C_1$-$C_4$ alcohols.

According to one embodiment particularly preferred in accordance with the invention, the flux bath is designed such that the alcohol of the alcohol/water mixture of the flux bath is selected from the group of methanol, ethanol, propan-1-ol, propan-2-ol, butan-1-ol, butan-2-ol, 2-methylpropan-1-ol, 2-methylpropan-2-ol, pentan-1-ol, pentan-2-ol, pentan-3-ol, 2-methylbutan-1-ol, 3-methylbutan-1-ol, 2-methylbutan-2-ol, 3-methylbutan-2-ol, 2,2-dimethylpropan-1-ol, hexan-1-ol, heptan-1-ol, octan-1-ol, nonan-1-ol, decan-1-ol, ethane-1,2-diol, propane-1,2-diol, cyclopentanol, cyclohexanol, prop-2-en-1-ol, but-2-en-1-ol and mixtures thereof, more particularly from the group of methanol, ethanol, propan-1-ol, propan-2-ol, butan-1-ol, butan-2-ol, 2-methylpropan-1-ol, 2-methylpropan-2-ol, pentan-1-ol, pentan-2-ol, pentan-3-ol, 2-methylbutan-1-ol, 3-methylbutan-1-ol, 2-methylbutan-2-ol, 3-methylbutan-2-ol, 2,2-dimethylpropan-1-ol and mixtures thereof, more preferably from the group of methanol, ethanol, propan-1-ol, propan-2-ol, butan-1-ol, butan-2-ol, 2-methylpropan-1-ol, 2-methylpropan-2-ol and mixtures thereof, more preferably still from the group of methanol, ethanol, propan-1-ol, propan-2-ol, butan-1-ol, butan-2-ol and mixtures thereof.

According to one embodiment which is especially preferred in accordance with the invention, the system is configured such that the alcohol of the alcohol/water mixture of the flux bath is selected from the group of methanol, ethanol, propan-1-ol, propan-2-ol, butan-1-ol, butan-2-ol and mixtures thereof.

According to one particular embodiment of the present invention, the alcohol of the alcohol/water mixture is a surfactant alcohol (i.e., an alcohol having surfactant properties), more particularly selected from alkoxylated, preferably ethoxylated or proxylated, $C_6$-$C_{25}$ alcohols, preferably $C_8$-$C_{15}$ alcohols, and alkoxylated, preferably ethoxylated or propoxylated, fatty alcohols, preferably $C_6$-$C_{30}$ fatty alcohols, hydroxyl-functional polyalkylene glycol ethers, hydroxyl-functional fatty alcohol alkoxylates, more particularly $C_6$-$C_{30}$ fatty alcohol alkoxylates, hydroxyl-functional alkyl(poly)glucosides and hydroxyl-functional alkylphenol alkoxylates and also mixtures thereof.

Within the system of the invention, provision may be made for the flux bath to further comprise at least one wetting agent and/or surfactant, more particularly at least one ionic or nonionic wetting agent and/or surfactant, preferably at least one nonionic wetting agent and/or surfactant.

The amounts of wetting agent and/or surfactant in the flux bath used in accordance with the invention may vary within wide ranges:

in particular the flux bath may comprise the at least one wetting agent and/or surfactant in amounts of 0.0001 to 15 wt %, preferably in amounts of 0.001 to 10 wt %, more preferably in amounts of 0.01 to 8 wt %, more preferably still in amounts of 0.01 to 6 wt %, very preferably in amounts of 0.05 to 3 wt %, more preferably still in amounts of 0.1 to 2 wt %, based on the flux bath.

Furthermore, the flux bath may comprise the at least one wetting agent and/or surfactant in amounts of 0.0001 to 10 vol %, preferably in amounts of 0.001 to 8 vol %, more preferably in amounts of 0.01 to 5 vol %, more preferably still in amounts of 0.01 to 5 vol %, very preferably in amounts of 0.05 to 3 vol %, more preferably still in amounts of 0.1 to 2 vol %, based on the flux bath.

As elucidated above in connection with the method of the invention, the amount and/or concentration of the flux composition used in accordance with the invention in the flux bath designed in accordance with the invention may likewise vary within wide ranges:

In particular, provision may be made for the flux bath to comprise the flux composition in an amount of at least 150 g/, more particularly in an amount of at least 200 g/l, preferably in an amount of at least 250 g/l, more preferably in an amount of at least 300 g/l, very preferably in an amount of at least 400 g/l, especially preferably in an amount of at least 450 g/l, more preferably still in an amount of at least 500 g/l, more particularly calculated as total salt content of the flux composition.

Furthermore, provision may be made in accordance with the invention for the flux bath to comprise the flux composition in an amount of 150 g/l to 750 g/l, more particularly in an amount of 200 g/l to 700 g/l, preferably in an amount of 250 g/l to 650 g/l, more preferably in an amount of 300 g/l to 625 g/l, very preferably in an amount of 400 g/l to 600 g/l, especially preferably in an amount of 450 g/l to 580 g/l, more preferably still in an amount of 500 g/l to 575 g/l, more particularly calculated as total salt content of the flux composition.

According to one particularly preferred embodiment, provision is made for the flux composition used in accordance with the invention to comprise as ingredients (i) zinc chloride ($ZnCl_2$), more particularly in amounts in the range from 50 to 95 wt %, preferably in the range from 55 to 90 wt %, more preferably in the range from 60 to 85 wt %, more preferably in the range from 65 to 82.5 wt %, more preferably still in the range from 70 to 82 wt %, (ii) ammonium chloride ($NH_4Cl$), more particularly in amounts in the range from 5 to 45 wt %, preferably in the range from 7.5 to 40 wt %, more preferably in the range from 10 to 35 wt %, very preferably in the range from 11 to 25 wt %, more preferably still in the range from 12 to 20 wt %, (iii) optionally at least one alkali metal and/or alkaline earth metal salt, more particularly in amounts in the range from 0.1 to 25 wt %, preferably in the range from 0.5 to 20 wt %, more preferably in the range from 1 to 15 wt %, very preferably in the range from 2 to 12.5 wt %, more preferably still in the range from 4 to 10 wt %, and (iv) at least one aluminum salt and/or at least one silver salt, more particularly aluminum chloride ($AlCl_3$) and/or silver chloride (AgCl), preferably aluminum chloride ($AlCl_3$), more particularly in amounts in the range from $1\cdot10^{-7}$ to 2 wt %, preferably in the range from $1\cdot10^{-6}$ to 1.5 wt %, more preferably in the range from $1\cdot10^{-5}$ to 1 wt %, very preferably in the range from $2\cdot10^{-5}$ to 0.5 wt %, more preferably still in the range from $5\cdot10^{-5}$ to $5\cdot10^{-3}$ wt %, where all of the above-stated quantity figures are based on the composition and are to be selected such as to result in a total of 100 wt %, and where the flux composition is at least substantially free, preferably entirely free, from lead chloride ($PbCl_2$) and nickel chloride ($NiCl_2$).

As already outlined above in connection with the method of the invention, component (iii) of the flux composition used in accordance with the invention may also vary within wide ranges: it is preferred in accordance with the invention if the flux composition comprises, as alkali metal and/or alkaline earth metal salt of component (iii), an alkali metal and/or alkaline earth metal chloride.

According to one typical embodiment, the flux composition used in accordance with the invention may comprise, as alkali metal and/or alkaline earth metal salt of component (iii), at least one alkali metal and/or alkaline earth metal salt of an alkali metal and/or alkaline earth metal from the group of lithium (Li), sodium (Na), potassium (K), rubidium (Rb), cesium (Cs), beryllium (Be), magnesium (Mg), calcium (Ca), strontium (Sr) and barium (Ba) and also combinations.

According to a further typical embodiment of the present invention, the flux composition used in accordance with the invention may comprise, as alkali metal and/or alkaline earth metal salt of component (iii), at least two alkali metal and/or alkaline earth metal salts different from one another, more particularly at least two alkali metal and/or alkaline earth metal salts of an alkali metal and/or alkaline earth metal from the group of lithium (Li), sodium (Na), potassium (K), rubidium (Rb), cesium (Cs), beryllium (Be), magnesium (Mg), calcium (Ca), strontium (Sr) and barium (Ba) and also combinations.

Lastly, according to a further typical embodiment, the flux composition used in accordance with the invention may comprise, as alkali metal and/or alkaline earth metal salt of component (iii), at least two alkali metal salts different from one another, more particularly two alkali metal chlorides different from one another, preferably sodium chloride and potassium chloride, more particularly with a sodium/potassium weight ratio in the range from 50:1 to 1:50, more particularly in the range from 25:1 to 1:25, preferably in the range from 10:1 to 1:10.

It is preferred in accordance with the invention if the flux composition used in accordance with the invention is at least substantially free, preferably entirely free, from cobalt chloride ($CoCl_2$), manganese chloride ($MnCl_2$), tin chloride ($SnCl_2$), bismuth chloride ($BiCl_3$) and antimony chloride ($SbCl_3$) as well.

It is further advantageous in accordance with the invention if the flux composition used in accordance with the invention is at least substantially free, preferably entirely free, from lead chloride ($PbCl_2$), nickel chloride ($NiCl_2$), cobalt chloride ($CoCl_2$), manganese chloride ($MnCl_2$), tin chloride ($SnCl_2$), bismuth chloride ($BiCl_3$) and antimony chloride ($SbCl_3$) and/or if the flux composition is at least substantially free, preferably entirely free, from chlorides from the group of lead chloride ($PbCl_2$), nickel chloride ($NiCl_2$), cobalt chloride ($CoCl_2$), manganese chloride ($MnCl_2$), tin chloride ($SnCl_2$), bismuth chloride ($BiCl_3$) and antimony chloride ($SbCl_3$).

It is likewise preferred in accordance with the invention if the flux composition used in accordance with the invention is at least substantially free, preferably entirely free, from salts and compounds of metals from the group of lead (Pb), nickel (Ni), cobalt (Co), manganese (Mn), tin (Sn), bismuth (Bi) and antimony (Sb).

Finally, it is particularly advantageous in accordance with the invention if the flux composition, apart from zinc chloride ($ZnCl_2$) and also from aluminum salt and/or silver salt, more particularly silver chloride (AgCl) and/or aluminum chloride ($AlCl_3$), is at least substantially free, preferably entirely free, from salts and compounds of transition metals and heavy metals.

Furthermore, it may be the case in accordance with the invention that the flux treatment facility (E) encompasses a means for contacting the iron or steel component with the flux bath and/or the flux composition, more particularly a means for immersion or for spray application, preferably a means for immersion. In particular, it may be the case here that the means for contacting the iron or steel component with the flux bath and/or the flux composition is controllable and/or is controlled in such a way, more particularly by means of a control means, that the iron or steel component is contacted for a time of 0.001 to 30 minutes, more particularly 0.01 to 20 minutes, preferably 0.1 to 15 minutes, preferably 0.5 to 10 minutes, more particularly 1 to 5 minutes, with the flux bath and/or the flux composition, being more particularly immersed into the flux bath. Moreover, it may in particular be the case in accordance with the invention that the means for contacting the iron or steel component with the flux bath and/or the flux composition is controllable and/or is controlled in such a way, more particularly by means of a control means, that the iron or steel component is contacted for a time of up to 30 minutes, more particularly up to 20 minutes, preferably up to 15 minutes, preferably up to 10 minutes, more particularly up to 5 minutes, with the flux bath and/or the flux composition, being more particularly immersed into the flux bath.

Furthermore, it may be the case in accordance with the invention that the drying treatment facility (F) is controllable and/or is controlled in such a way, more particularly by means of a control means, that the drying treatment takes place at a temperature in the range from 50 to 400° C., more particularly in the range from 75 to 350° C., preferably in the range from 100 to 300° C., more preferably in the range from 125 to 275° C., very preferably in the range from 150 to 250° C., and/or that the drying treatment in method step (f) takes place at a temperature of up to 400° C., more particularly up to 350° C., preferably up to 300° C., more preferably up to 275° C., very preferably up to 250° C.

Moreover, it may be the case in accordance with the invention that the drying treatment facility (F) is controllable and/or is controlled in such a way, more particularly by means of a control means, that the drying treatment is carried out in such a way that the surface of the iron or steel component during drying has a temperature in the range from 100 to 300° C., more particularly in the range from 125 to 275° C., preferably in the range from 150 to 250° C., more preferably in the range from 160 to 225° C., very preferably in the range from 170 to 200° C.

The drying treatment is typically operated in the presence of air. For this purpose, the drying treatment facility (F) may comprise at least one inlet for the introduction and/or admission of air.

The drying treatment facility (F) customarily encompasses at least one drying means, more particularly at least one oven.

With regard to the hot dip galvanizing facility (G) of the system of the invention, it encompasses at least one aluminum-containing, more particularly aluminum-alloyed, zinc melt ("Zn/Al melt"), more particularly at least one galvanizing bath comprising an aluminum-containing, more particularly aluminum-alloyed, zinc melt, preferably designed for the dipping of iron or steel components.

In this context, the system of the invention is typically configured in such a way that the aluminum-containing, more particularly aluminum-alloyed, zinc melt ("Zn/Al melt") and/or the galvanizing bath comprises an amount of aluminum in the range from 0.0001 to 25 wt %, more particularly in the range from 0.001 to 20 wt %, preferably in the range from 0.005 to 17.5 wt %, more preferably in the range from 0.01 to 15 wt %, very preferably in the range from 0.02 to 12.5 wt %, especially preferably in the range from 0.05 to 10 wt %, more preferably still in the range from 0.1 to 8 wt %, based on the aluminum-containing, more particularly aluminum-alloyed, zinc melt ("Zn/Al melt") and/or the galvanizing bath, in particular where the aluminum-containing. In particular it is possible here for the aluminum-alloyed, zinc melt ("Zn/Al melt"), and/or the galvanizing bath, based on the aluminum-containing, more particularly aluminum-alloyed, zinc melt ("Zn/Al melt") and/or the galvanizing bath, to comprise an amount of zinc of at least 75 wt %, more particularly at least 80 wt %, preferably at least 85 wt %, more preferably at least 90 wt %, and also, optionally, to comprise at least one further metal, more particularly in amounts of up to 5 wt % and/or more particularly selected from the group of bismuth (Bi), lead (Pb), tin (Sn), nickel (Ni), silicon (Si), magnesium (Mg) and combinations thereof. Here, all of the above-stated quantity figures are to be selected such as to result in a total of 100 wt %.

Typically, the system of the invention is configured here in such a way that the aluminum-containing, more particularly aluminum-alloyed, zinc melt ("Zn/Al melt") and/or the galvanizing bath has the following composition, where all of the below-stated quantity figures are based on the aluminum-containing, more particularly aluminum-alloyed, zinc melt ("Zn/Al melt") and/or the galvanizing bath and are to be selected such as to result in a total of 100 wt %:

(i) zinc (Zn), more particularly in amounts in the range from 75 to 99.9999 wt %, more particularly in the range from 80 to 99.999 wt %, preferably in the range from 82.5 to 99.995 wt %, more preferably in the range from 85 to 99.99 wt %, very preferably in the range from 87.5 to 99.98 wt %, especially preferably in the range from 90 to 99.95 wt %, more preferably still in the range from 92 to 99.9 wt %, (ii) aluminum (Al), more particularly in amounts in the range from 0.0001 to 25 wt %, more particularly in the range from 0.001 to 20 wt %, preferably in the range from 0.005 to 17.5 wt %, more preferably in the range from 0.01 to 15 wt %, very preferably in the range from 0.02 to 12.5 wt %, especially preferably in the range from 0.05 to 10 wt %, more preferably still in the range from 0.1 to 8 wt %, (iii) optionally bismuth (Bi), more particularly in amounts of up to 0.5 wt %, preferably in amounts of up to 0.3 wt %, more preferably in amounts of up to 0.1 wt %, (iv) optionally lead (Pb), more particularly in amounts of up to 0.5 wt %, preferably in amounts of up to 0.2 wt %, more preferably in amounts of up to 0.1 wt %, (v) optionally tin (Sn), more particularly in amounts of up to 0.9 wt %, preferably in amounts of up to 0.6 wt %, more preferably in amounts of up to 0.3 wt %, (vi) optionally nickel (Ni), more particularly in amounts of up to 0.1 wt %, preferably in amounts of up to 0.08 wt %, more preferably in amounts of up to 0.06 wt %, (vii) optionally silicon (Si), more particularly in amounts of up to 0.1 wt %, preferably in amounts of up to 0.05 wt %, more preferably in amounts of up to 0.01 wt %, (viii) optionally magnesium (Mg), more particularly in amounts of up to 5 wt %, preferably in amounts of up to 2.5 wt %, more preferably in amounts of up to 0.8 wt %.

According to one embodiment of the present invention, the aluminum-containing, more particularly aluminum-alloyed, zinc melt ("Zn/Al melt") and/or the galvanizing bath may have a temperature in the range from 375° C. to 750° C., more particularly temperature in the range from 380° C. to 700° C., preferably temperature in the range from 390° C. to 680° C., more preferably still in the range from 395° C. to 675° C.

The system of the invention is typically designed in such a way that the hot dip galvanizing facility (G) is configured and/or is operable and/or is configured and/or operated in such a way, more particularly controllable and/or controlled in such a way, more particularly by means of a control means, that the iron or steel component is immersed into the aluminum-containing, more particularly aluminum-alloyed, zinc melt ("Zn/Al melt") and/or into the galvanizing bath, being more particularly immersed and agitated therein, more particularly for a period sufficient to ensure effective hot dip galvanizing, more particularly for a period in the range from 0.0001 to 60 minutes, preferably in the range from 0.001 to 45 minutes, more preferably in the range from 0.01 to 30 minutes, more preferably still in the range from 0.1 to 15 minutes.

According to one typical embodiment of the present invention, it may be the case that the hot dip galvanizing facility (G) comprises at least one means for contacting and/or rinsing or pervading the aluminum-containing, more particularly aluminum-alloyed, zinc melt ("Zn/Al melt") and/or the galvanizing bath with at least one inert gas, more particularly nitrogen.

As already described above in connection with the method of the invention, the system of the invention may in principle be continuously or discontinuously operable in design and/or may in principle be continuously or discontinuously operated.

In particular, the system of the invention may be configured in such a way that the iron or steel component can be hot dip galvanized as an individual product or as a multiplicity of individual products or such that the iron or steel component can be hot dip galvanized as an elongate product, more particularly as a wire, tube, sheet or coil material or the like.

Furthermore, it may be the case in accordance with the invention that the system of the invention, downstream in process direction to the hot dip galvanizing facility (F), further comprises at least cooling facility (H) for cooling the iron or steel component hot dip galvanized in the hot dip galvanizing facility (F). In particular, the cooling facility (H) can be configured to be operable and/or operated in the presence of air Furthermore, the system of the invention, downstream in process direction to the optional cooling facility (H), can further comprise at least one afterworking for aftertreating facility (I) for afterworking and/or aftertreating the hot dip galvanized and cooled iron or steel component.

For further details of the system of the invention, reference may be made, in order to avoid unnecessary repetition, to the above observations concerning the method of the invention, which apply correspondingly in relation to the system of the invention.

A further subject of the present invention—according to a third aspect of the present invention—is a flux bath for the flux treatment of iron or steel components in a hot dip galvanizing process, where the flux bath encompasses a liquid phase comprising an alcohol/water mixture, the liquid phase of a flux bath comprising a flux composition, more particularly in dissolved or dispersed form, preferably in dissolved form, and where the flux composition comprises as ingredients (i) zinc chloride ($ZnCl_2$), (ii) ammonium chloride ($NH_4Cl$), (iii) optionally at least one alkali metal and/or alkaline earth metal salt and (iv) at least one aluminum salt and/or at least one silver salt, more particularly aluminum chloride ($AlCl_3$) and/or silver chloride (AgCl), preferably aluminum chloride ($AlCl_3$), and where the flux composition is at least substantially free, preferably entirely free, from lead chloride ($PbCl_2$) and nickel chloride ($NiCl_2$).

For further details of the flux bath of the invention, reference may be made, in order to avoid unnecessary repetition, to the above observations concerning the method of the invention, and to the system of the invention which apply correspondingly in relation to the flux bath of the invention.

A further subject of the present invention—according to a fourth aspect of the present invention—is a flux composition for the flux treatment of iron or steel components in a hot dip galvanizing process, where the flux composition comprises as ingredients (i) zinc chloride ($ZnCl_2$), (ii) ammonium chloride ($NH_4Cl$), (iii) optionally at least one alkali metal and/or alkaline earth metal salt and (iv) at least one aluminum salt and/or at least one silver salt, more particularly aluminum chloride ($AlCl_3$) and/or silver chloride (AgCl), preferably aluminum chloride ($AlCl_3$), and where the flux composition is at least substantially free, preferably entirely free, from lead chloride ($PbCl_2$) and nickel chloride ($NiCl_2$).

According to one preferred embodiment, the flux composition of the invention is present in solution or dispersion, preferably in solution, in a liquid phase of a flux bath, where the liquid phase of the flux bath encompasses an alcohol/water mixture.

For further details in relation to the flux composition of the invention, reference may be made, in order to avoid unnecessary repetition, to the above observations concerning the method of the invention, the system of the invention, and the flux bath of the invention, which apply correspondingly in relation to the flux composition of the invention.

Yet a further subject of the present invention—according to a fifth and sixth aspect of the present invention—is the use of the above-described flux bath of the invention and, respectively, of the above-described flux composition of the invention for the flux treatment of iron or steel components in a hot dip galvanizing process.

In the context of the use in accordance with the invention, it is the case in particular that the flux composition is combined with a flux bath, where the flux bath encompasses a liquid phase comprising an alcohol/water mixture, the liquid phase of the flux bath comprising the flux composition, more particularly in dissolved or dispersed form, preferably in dissolved form.

For further details of the use in accordance with the invention, reference may be made to the above observations in relation to the other aspects of the invention, which apply correspondingly for the use in accordance with the invention as well.

A final subject of the present invention—according to a seventh aspect—is a hot dip galvanized iron or steel component obtainable by a method of the invention as described above and/or in a system of the invention as described above.

As already indicated at the outset and in particular also documented by the working examples according to the invention, there are particular advantages associated with the products of the invention, especially a reduced transition metal and/or heavy metal content and also improved mechanical properties and corrosion protection properties.

With regard to the hot dip galvanized iron or steel component of the invention, it is provided on its surface with a hot dip galvanization layer of 0.5 to 300 μm in thickness, more particularly 1 to 200 μm in thickness, preferably 1.5 to 100 μm in thickness, more preferably 2 to 30 μm in thickness.

With regard, furthermore, to the hot dip galvanized iron or steel component of the invention, this hot dip galvanized iron or steel component is provided on its surface with a hot dip galvanization layer, the hot dip galvanization layer being at least substantially free, preferably entirely free, from lead (Pb) and/or nickel (Ni) originating from the flux treatment.

It is particularly preferred in accordance with the invention if the hot dip galvanized iron or steel component is provided on its surface with a hot dip galvanization layer, the hot dip galvanization layer being at least substantially free, preferably entirely free, from heavy metals originating from the flux treatment and from the group of lead (Pb), nickel (Ni), cobalt (Co), manganese (Mn), tin (Sn), bismuth (Bi) and antimony (Sb).

For further details regarding this aspect of the invention it is possible, in order to avoid unnecessary repetition, to refer to the above observations concerning the other aspects of the invention, which apply correspondingly for this aspect of the invention as well.

Further features, advantages and possible applications of the present invention are apparent from the description hereinafter of exemplary embodiments on the basis of drawings, and from the drawings themselves. Here, all features described and/or depicted, on their own or in any desired combination, constitute the subject matter of the present invention, irrespective of their subsumption in the claims and their dependency references.

Figure 2:
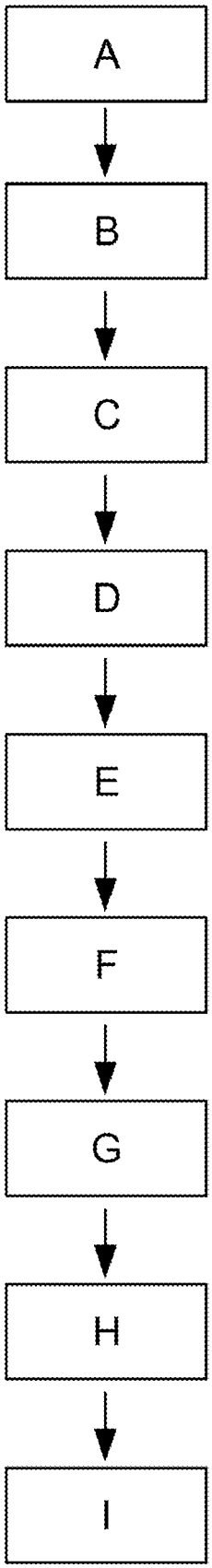
FIG. 2 shows a schematic representation of a system of the invention according to one particular embodiment of the present invention.

In these drawings:

FIG. shows a schematic method sequence of the individual stages or method steps of the method of the invention according to one particular embodiment of the present invention;

FIG. 2 shows a schematic representation of a system of the invention according to one particular embodiment of the present invention.

In the flow diagram of the method shown in FIG. 1, the successive method stages or method steps a) to i) are shown schematically, with method steps b), d), f), h), and i), especially method steps h) and i), being optional.

In accordance with the diagram shown in FIG. 1, the method sequence is as follows, the method of the invention successively comprising the below-specified steps in this order: degreasing (step a)), rinsing (step b), optional), pickling (step c)), rinsing (step d), optional), flux bath treatment (step e)), drying (step f), optional), hot dip galvanizing (step g)), cooling (step h), optional), and afterworking or aftertreating (step i), optional).

For further details concerning the method sequence according to the invention, reference may be made to the general observations above concerning the method of the invention.

FIG. 2 shows, schematically, the system according to the present invention, with the individual facilities (A) to (I), with facilities (B), (D), (F), (H) and (I), more particularly facilities (H) and (I), being optional.

According to the diagram of the system of the invention shown in FIG. 2, this system comprises, in the order listed below, the following facilities: degreasing facility (A), optionally rinsing facility (B), pickling facility (C), optionally rinsing facility (D), flux treatment facility (E), optionally drying facility (F), hot dip galvanizing facility (G), optionally cooling facility (H), and optionally afterworking or aftertreating facility (I).

For further details relating to the system of the invention, reference may be to the general observations above concerning the system according to the present invention.

Further configurations, modifications and variations of the present invention are readily recognizable and realizable for the skilled person reading the description, without that person departing from the scope of the present invention.

The present invention is illustrated with the exemplary embodiments below, which, however, are in no way intended to limit the present invention, but which instead merely illustrate the exemplary and nonlimiting modes of implementation and configuration.

EXEMPLARY EMBODIMENTS

General Protocol for Implementation (Inventive)

Various hot dip galvanizing cycles are carried out with specimen sheets of type S235 (2 mm thickness, 100 mm×100 mm width) according to the method sequence of the invention as per FIG. 1 and with the system of the invention as per FIG. 2. The flux composition and the zinc bath alloys are varied in each case according to the details below.

The hot dip galvanizing process carried out in each case encompasses the following method steps in the order listed below (the system employed in accordance with the invention is designed accordingly);

(a) alkaline degreasing treatment in a degreasing bath (15 minutes, 70° C., degreasing bath composition as per example 1 of EP 1 352 100 B1),
(b) twofold rinsing in two successive rinsing baths with water,
(c) acidic pickling treatment (40 minutes, 30° C., pickling bath composition as per example 1 of EP 1 352 100 B1),
(d) twofold rinsing in two successive rinsing baths with water,
(e) flux treatment in flux bath according to specifications below (3 minutes, 60° C., dip treatment),
(f) drying treatment (hot air stream 260° C., 30 seconds),
(g) hot dip galvanizing with an aluminum-containing or aluminum-alloyed zinc melt ("Zn/Al melt") in a galvanizing bath according to specifications below (50 seconds' dip treatment of the preheated and fluxed sheet in the galvanizing bath, 450° C.),
(i) air cooling of the hot dip galvanized sheet removed from the galvanizing bath.

Example Series 1 (Inventive)

Various specimen sheets are subjected to hot dip galvanization as described above, including corresponding pretreatment steps as described above. The specification of the flux composition used and of the flux bath used is as follows:

Flux Composition:

78.995 wt % $ZnCl_2$, 13 wt % $NH_4Cl$, 6 wt % NaCl, 2 wt % KCl, 0.005 wt % (50 ppm) $AlCl_3$ Flux Bath:

Flux amount/concentration (total salt content): 550 g/l

Ammonia solution (5%): 10 ml per liter of flux bath to adjust (raise) the pH pH: 3.5 (without ammonia solution: 3.2)

wetting agent (nonionic surfactant): 0.3%

Variation of the Alcohol Fraction in the Flux Bath a) 0% propanol (100% water)

b) 5% propanol (40 g propanol, balance to 1000 ml made up with water)

c) 20% propanol (160 g propanol, balance to 1000 ml made up with water)

d) 71.8% propanol (574.4 g propanol, balance to 1000 ml made up with water)

e) 100% propanol

Galvanizing Bath 100 ppm aluminum, 0.05 wt % bismuth, 0.3 wt % tin, 0.04 wt % nickel, balance zinc (i.e., ad 100 wt %)

Results ad a) By being immersed into the flux solution, the sheet is fully covered with salts. After the drying step, the surface of the component is still completely damp. A very largely homogeneous zinc layer is formed, but with minimal flaws.

ad b) By being immersed into the flux solution, the sheet is fully covered with salts. After the drying step, the surface of the component has already slightly dried. For monitoring, the sheets are weighed after pickling and after drying. In comparison to variant a), it is found that the film of flux weight 2.5% less, attributable to a lower residual moisture content as a result of more rapid drying. After galvanization, a homogeneous zinc layer is formed, without any flaws.

ad c) By being immersed into the flux solution, the sheet is fully covered with salts. After the drying step, the surface of the component is very largely dry. In a comparison of the weights of the film of the flux with variant a), an 11.5% weight reduction is found. After galvanization, a homogeneous zinc layer is formed, without any flaws.

ad d) By being immersed into the flux solution, the sheet is fully covered with salts. After the drying step, the surface of the component is completely dry. In a comparison of the weights of the film of the flux with variant a), a 15% reduction is found. After galvanization, a homogeneous zinc layer is formed, without any flaws.

ad e) The flux salts form a sediment which cannot be dissolved. Accordingly, when the sheet is immersed into the flux, there is no efficient wetting of the steel surface with flux salts. On subsequent galvanizing, there is no reaction between zinc alloy and steel; in other words, galvanizability is not efficient.

General Findings

Under the same drying conditions (i.e., equal drying times and drying temperatures), the use of alcohol in the flux bath, even with small quantitative fractions and also up to high qualitative fractions, results in more rapid drying of the film of flux and to a better quality of galvanization. The result of this is that better drying leads to a better quality of galvanization.

In corrosion tests as well (salt spray test or salt spray mist test according to DIN EN ISO 9227:2012), the hot dip galvanized sheets pretreated with the alcohol-containing flux exhibit significantly longer service lives (a service life improvement of up to 40%) relative to hot dip galvanized sheets pretreated with the otherwise identical flux (but without any alcohol fraction, i.e., purely aqueous),

Example Series 2 to 5 (Inventive)

Example series 1 is repeated, but with a different composition of the galvanizing bath.

Galvanizing Bath for Example Series 2

500 ppm aluminum, 0.05 wt % bismuth, 0.3 wt % tin, 0.04 wt % nickel, balance zinc (i.e., ad 100 wt %)

Galvanizing Bath for Example Series 3

1000 ppm aluminum, 50 ppm silicon, balance zinc (i.e., ad 100 wt %)

Galvanizing Bath for Example Series 4

5.42 wt % aluminum, balance zinc (i.e., ad 100 wt %)

Galvanizing Bath for Example Series 5

Aluminum 4.51 wt %, balance zinc (i.e., ad 100 wt %)

Results

Results analogous to those for example series 1 are obtained, and specifically in the case of example series 4 and 5, the resulting surfaces also show significant optical improvement, in other words being particularly glossy.

Example Series 6 to 10 (Inventive)

Example series 1 to 5 are repeated, but with a differing flux composition (use of 0.005 wt % or 50 ppm of AgCl instead of $AlCl_3$).

Results

Results analogous to those of example series 1 to 5 are obtained.

Example Series 11 to 15 (Inventive)

Example series 1 to 5 are repeated, but with a differing flux composition (use of a combination of 0.0025 wt % or 25 ppm of AgCl and 0.0025 wt % or 25 ppm of $AlCl_3$ instead of $AlCl_3$ alone).

Results

Results analogous to those of example series 1 to 5 are obtained.

Example Series 16 to 30 (Comparative)

Example series 1 to 15 are repeated, but with a differing flux composition (complete omission of $AlCl_3$ and AgCl).

Results

In the case of the alcohol contents a) to d), in each case after galvanization, the results are highly inhomogeneous zinc layers with a significant number of flaws and distinctly visible defect structures.

In the case of the alcohol contents of e), here again there is no galvanizability at all, because the flux salts form an insoluble sediment.

General Recipes for Fluxes (Inventive)

Given below is general recipe information for typical flux compositions and flux baths of the invention, with optimization depending on the composition of the zinc/aluminum melt.

Flux Composition $ZnCl_2$ 56 to 85% for Al=4.2 to 6.2%: typically 77 to 82% for Al up to 1000 ppm: typically 56 to 62%

$NH_4Cl$ 10 to 44% for Al=4.2 to 6.2%: typically 10 to 15% for Al up to 1000 ppm: typically 38 to 44%

NaCl >0 to 6% for Al=4.2 to 6.2%: typically 5 to 7% for Al up to 1000 ppm: typically >0 to 1%

KCl >0 to 6% for Al=4.2 to 6.2%: typically 1 to 3% for Al up to 1000 ppm: typically >0 to 0.5%

$AgCl/AlCl_3$ 0.5 to 500 ppm

All percentages (wt %) above are based on the salt solids content (dry weight).

Flux Bath

Salt content (flux composition) in total 200 to 700 g/l, typically 450 to 550 g/l pH in the range from 2.5 to 5 for Al=4.2 to 6.2%: typically 2.5 to 3.5 for Al up to 1000 ppm: typically 4 to 5% sufficient amount of inorganic acid and ammonia solution to adjust the required pH (fine adjustment with ammonia solution)

Flux temperature in the range from 15 to 80° C.

for Al=4.2 to 6.2%: typically 50 to 70° C.

for Al up to 1000 ppm: typically 35 to 60° C.

Wetting agent content 0.2 to 5%

Solution with a propanol and/or ethanol fraction of 0.2 to 72% for Al=4.2 to 6.2%: typically 5 to 20% for Al up to 1000 ppm: typically 5 to 20%

The invention claimed is:

1. A method for hot-dip galvanization of an iron or steel component, wherein the method comprises the following method steps in the order listed below:

(a) degreasing treatment of the iron or steel component; then (b) optionally, rinsing of the iron or steel component which has been previously degreased in method step (a); then (c) pickling treatment of the iron or steel component which has been previously degreased in method step (a) and optionally rinsed in method step (b); then (d) optionally, rinsing of the iron or steel component which has been previously pickled in method step (c); then (e) flux treatment of the iron or steel component which has been previously pickled in method step (c) and optionally rinsed in method step (d), by means of a flux composition comprised in a flux bath, wherein the flux bath comprises a liquid phase comprising an alcohol-water mixture, with the liquid phase of the flux bath comprising the flux composition, wherein the alcohol of the alcohol-water mixture of the flux bath is a water-miscible or a water-soluble alcohol and is selected from the group of $C_1$-$C_6$ alcohols and mixtures thereof, and wherein the flux composition comprises as ingredients:

(i) zinc chloride in amounts in the range of from 70 to 82 wt. %, (ii) ammonium chloride in amounts in the range of from 12 to 20 wt. %, (iii) at least one of an alkali metal or alkaline earth metal salt in amounts in the range of from 4 to 10 wt. %, and (iv) at least one of an aluminum salt or silver salt in amounts sufficient to precipitate low levels of organic impurities soluble in the alcohol-water mixture, wherein the amounts sufficient range from $5 \cdot 10^{-5}$ to $5 \cdot 10^{-3}$ wt. %, wherein all amounts are based on the composition and are to be selected as to result in a total of 100 wt. %, and wherein the flux composition is free from any further transition metals and heavy metals; then (f) optionally, drying treatment of the iron or steel component which has been previously subjected to the flux treatment in method step (e); then (g) hot-dip galvanization of the iron or steel component which has been previously subjected to the flux treatment in method step (e) and optionally dried in method step (f), in a galvanizing bath comprising an aluminum-containing zinc melt, wherein the aluminum-containing zinc melt comprises an amount of aluminum in the range of from 0.1 to 8 wt. %.

2. The method as claimed in claim 1, wherein the flux bath is adjusted to an acidic pH value.

3. The method as claimed in claim 1,
wherein the flux bath is adjusted to a pH value range from 0 to 6.9.

4. The method as claimed in claim 1,
wherein the flux bath is adjusted to a pH value range from 1.5 to 5.

5. The method as claimed in claim 1,
wherein the flux bath comprises the alcohol-water mixture in a weight-based alcohol-water ratio in the range of from 0.5:9.5 to 99:1, based on the alcohol-water mixture.

6. The method as claimed in claim 1,
wherein the flux bath comprises the alcohol-water mixture in a weight-based alcohol-water ratio in the range of from 10:90 to 30:70, based on the alcohol-water mixture.

7. The method as claimed in claim 1,
wherein the alcohol of the alcohol-water mixture of the flux bath is selected from the group of $C_1$-$C_4$ alcohols and mixtures thereof.

8. The method as claimed in claim 1,
wherein the aluminum salt is aluminum chloride $AlCl_3$.

9. The method as claimed in claim 1,
wherein the silver salt is silver chloride AgCl.

10. The method as claimed in claim 1,
wherein the flux composition comprises, as alkali metal or alkaline earth metal salt of component (iii), an alkali metal or alkaline earth metal chloride.

11. The method as claimed in claim 1,
wherein the flux composition comprises, as alkali metal or alkaline earth metal salt of component (iii), at least two alkali metal or alkaline earth metal salts different from one another.

12. A method for hot-dip galvanization of an iron or steel component,
wherein the method comprises the following method steps in the order listed below:
(a) degreasing treatment of the iron or steel component; then
(b) optionally, rinsing of the iron or steel component which has been previously degreased in method step (a); then
(c) pickling treatment of the iron or steel component which has been previously degreased in method step (a) and optionally rinsed in method step (b); then
(d) optionally, rinsing of the iron or steel component which has been previously pickled in method step (c); then
(e) flux treatment of the iron or steel component which has been previously pickled in method step (c) and optionally rinsed in method step (d), by means of a flux composition comprised in a flux bath,
wherein the flux bath comprises a liquid phase comprising an alcohol-water mixture, with the liquid phase of the flux bath comprising the flux composition, wherein the alcohol of the alcohol-water mixture of the flux bath is a water-miscible or a water-soluble alcohol and is selected from the group of $C_1$-$C_6$ alcohols and mixtures thereof, and
wherein the flux composition consists of the following ingredients:
(i) zinc chloride in amounts in the range of from 70 to 82 wt. %,
(ii) ammonium chloride in amounts in the range of from 12 to 20 wt. %,
iii) sodium chloride and potassium chloride in amounts in the range of from 4 to 10 wt. %, and
(iv) at least one of an aluminum salt or silver salt in amounts in the range of from $5 \cdot 10^{-5}$ to $5 \cdot 10^{-3}$ wt. %,
wherein all amounts are based on the composition and are to be selected such as to result in a total of 100 wt. %, and
wherein the flux composition is free from any further transition metals and heavy metals; then
(f) optionally, drying treatment of the iron or steel component which has been previously subjected to the flux treatment in method step (e); then
(g) hot-dip galvanization of the iron or steel component which has been previously subjected to the flux treatment in method step (e) and optionally dried in method step (f), in a galvanizing bath comprising an aluminum-containing zinc melt, wherein the aluminum-containing zinc melt comprises an amount of aluminum in the range of from 0.1 to 8 wt. %.

* * * * *